US007669845B2

(12) United States Patent
Graef et al.

(10) Patent No.: US 7,669,845 B2
(45) Date of Patent: Mar. 2, 2010

(54) CASH DISPENSING AUTOMATED BANKING MACHINE AND METHOD

(75) Inventors: H. Thomas Graef, Bolivar, OH (US); Ken Kontor, Chesterland, OH (US); Michael Harty, North Canton, OH (US); Brian Jones, Navarre, OH (US)

(73) Assignee: Diebold Self-Service Systems division of Diebold, Incorporated, North Canton, OH (US)

( * ) Notice: Subject to any disclaimer, the term of this patent is extended or adjusted under 35 U.S.C. 154(b) by 1 day.

(21) Appl. No.: 11/728,497

(22) Filed: Mar. 26, 2007

(65) Prior Publication Data

US 2008/0012205 A1 Jan. 17, 2008

Related U.S. Application Data

(62) Division of application No. 10/796,349, filed on Mar. 9, 2004, now Pat. No. 7,195,237.

(60) Provisional application No. 60/453,146, filed on Mar. 10, 2003.

(51) Int. Cl.
*B65H 3/52* (2006.01)
*B65H 5/02* (2006.01)
*B65H 5/04* (2006.01)

(52) U.S. Cl. ..... 271/121; 271/124; 271/274; 271/125; 271/198; 271/113; 271/10.09; 271/116; 273/124; 235/379; 339/110; 339/107

(58) Field of Classification Search ..... 271/121, 271/24, 274, 125, 124, 198, 119, 113, 10.09, 271/116; 273/124; 235/379; 339/110, 107
See application file for complete search history.

(56) References Cited

U.S. PATENT DOCUMENTS

| | | | | | |
|---|---|---|---|---|---|
| 2,455,836 | A | * | 12/1948 | Brummelen | 271/120 |
| 3,364,636 | A | | 1/1968 | Salsig, Jr. | |
| 3,572,691 | A | * | 3/1971 | Heinricy | 271/23 |
| 4,469,454 | A | * | 9/1984 | Crean | 400/144.2 |
| 4,474,365 | A | | 10/1984 | DiBlasio | |
| 4,494,747 | A | | 1/1985 | Graef et al. | |
| 4,552,352 | A | * | 11/1985 | Nickels et al. | 271/10.11 |
| 4,607,833 | A | | 8/1986 | Svyatski et al. | |
| 4,615,518 | A | | 10/1986 | Di Blasio | |
| 4,660,822 | A | * | 4/1987 | Winkler et al. | 271/10.11 |
| 4,691,910 | A | * | 9/1987 | Cargill et al. | 271/3.15 |
| 4,779,861 | A | | 10/1988 | Ozawa et al. | |
| 5,098,078 | A | | 3/1992 | Nakanishi | |
| 5,207,788 | A | * | 5/1993 | Geib et al. | 271/122 |
| 5,265,859 | A | | 11/1993 | Watson et al. | |
| 5,421,569 | A | * | 6/1995 | Davidson | 271/109 |
| 5,449,161 | A | * | 9/1995 | Gysling | 271/119 |

(Continued)

*Primary Examiner*—Gene O. Crawford
*Assistant Examiner*—Rakesh Kumar
(74) *Attorney, Agent, or Firm*—Ralph E. Jocke; Christopher Parmelee; Walker & Jocke

(57) ABSTRACT

An automated banking machine (10) includes at least one sheet dispensing mechanism (34, 36, 38, 40, 210). Each sheet dispensing mechanism includes a picking member (72, 212). The picking member rotates, and with each rotation causes an end sheet to be picked from a stack (42, 264) of sheets. The picking member (212) includes an arcuate projecting portion (258) that reduces the risk of damage to the leading edge areas of sheets due to opposed picking and stripping forces.

22 Claims, 15 Drawing Sheets

U.S. PATENT DOCUMENTS 5,769,410 A * 6/1998 Davidson et al. ..... 271/109
5,875,583 A * 3/1999 Church ..... 43/43.13
5,921,539 A * 7/1999 Westcott et al. ..... 271/10.03
5,953,985 A * 9/1999 Kobayashi ..... 101/116
6,000,689 A * 12/1999 Furuki et al. ..... 271/10.11
6,025,936 A 2/2000 Ishida
6,059,279 A * 5/2000 Wenthe, Jr. ..... 271/10.13
6,128,402 A * 10/2000 Jones et al. ..... 382/135
6,152,366 A * 11/2000 Maddox et al. ..... 235/381
6,186,490 B1 * 2/2001 Sugiura et al. ..... 271/10.09
6,241,244 B1 6/2001 Modi
D444,803 S 7/2001 Graef et al.
6,260,840 B1 * 7/2001 Suga et al. ..... 271/10.12
6,262,518 B1 * 7/2001 Ishikawa et al. ..... 310/355
6,311,819 B1 * 11/2001 Stromme et al. ..... 194/207
6,331,000 B1 12/2001 Beskitt et al.
6,378,858 B1 * 4/2002 Suga ..... 271/10.01
6,382,619 B1 5/2002 Gustafson et al.
6,457,707 B1 10/2002 Hendrix et al.
6,510,960 B1 * 1/2003 Christopherson et al. 220/345.3
6,634,636 B2 10/2003 Graef et al.
6,655,679 B2 12/2003 Boucher et al.
6,798,899 B2 9/2004 Mennie et al.
2001/0042292 A1 11/2001 Graef et al.
2003/0122298 A1 7/2003 Sheng et al.
2004/0094889 A1 5/2004 Graef et al.

* cited by examiner

CASH DISPENSING AUTOMATED BANKING MACHINE AND METHOD

CROSS REFERENCE TO RELATED APPLICATIONS

This application is a divisional of U.S. application Ser. No. 10/796,349 filed Mar. 9, 2004, which claims benefit under 35 U.S.C. §119(e) of U.S. Provisional Application 60/453,146 filed Mar. 10, 2003, and the disclosures of each are incorporated herein by reference.

TECHNICAL FIELD

This invention relates to automated transaction machines. Specifically this invention relates to an automated transaction machine including a note delivery mechanism for delivering sheets one sheet at a time from a stack.

BACKGROUND ART

Automated transaction machines include automated banking machines. A common type of automated banking machine is an automated teller machine ("ATM"). ATMs may be used to perform transactions such as dispensing cash, accepting deposits, making account balance inquiries, paying bills and transferring funds between accounts. ATMs and other types of automated banking machines may be used to dispense documents such as tickets, scrip, vouchers, checks, gaming materials, receipts or other documents. While many types of automated banking machines, including ATMs, are operated by consumers, other types of automated banking machines may be operated by service providers. Such automated banking machines may be used by service providers to provide cash or other types of sheets or documents when performing transactions for customers. For purposes of this disclosure, an automated banking machine shall be construed as any machine that is capable of carrying out transactions which include transfers of value.

A popular brand of automated banking machine is manufactured by Diebold, Incorporated, the assignee of the present invention. Such automated banking machines are capable of selectively dispensing sheets to users of the machine. A sheet dispensing mechanism used in such machines includes a picking mechanism which delivers or "picks" sheets generally one at a time from a stack of sheets stored within the machine. The sheets are transported through one or more transports within the machine and eventually delivered to a user. A picking mechanism used in some Diebold automated banking machines is described in U.S. Pat. No. 5,577,720, the disclosure of which is incorporated herein by reference. The picking mechanism includes a rotating picking member that comprises a plurality of cylindrical portions disposed along a shaft. Each cylindrical portion includes a high friction segment along a portion of the circumference. These high friction segments are sized and positioned such that upon each rotation of the picking member, an end note bounding an end of the stack is exposed to the moving high friction segment. Such exposure causes the end note to be moved away from the stack in engagement with the moving cylindrical portions of the picking member.

Disposed adjacent to each of the cylindrical portions of the picking member and in the direction of rotation of the picking member relative to the stack when picking the notes, is at least one stripping member. A stripping member is disposed in generally abutting relation with each of the cylindrical portions of the picking member. Each stripping member is generally circular and generally does not rotate during rotation of the picking member in a note picking direction. The stripping member generally operates to prevent all but the end note from moving out of the stack upon rotation of the picking member. The stripping member operates to prevent generally all but the end note from being delivered from the stack because the force applied by the picking member directly on the end note exceeds the resistance force applied by the stripping member to the end note. However the resistance force of the stripping member acting on notes in the stack other than the end note, because such notes are not directly engaged with the picking member, generally prevents the other notes from moving from the stack.

In the exemplary embodiment of the picking mechanism, the stripping members are each supported through one-way clutch mechanisms. These one-way clutch mechanisms prevent the stripping members from turning responsive to the force applied to the stripping members as the picking member moves to pick a note. However the one-way clutch in connection with each stripping member enables each stripping member to rotate in a direction opposite to that which the stripping member is urged to move during picking. This is useful in situations where a doubles detector senses that more than one note has moved past the stripping member. In such circumstances a controller operating in the banking machine may operate to cause the picking member to rotate in an opposed direction, which is the opposite of the direction in which the picking member normally moves when picking a note. As the picking member moves in this opposed direction, the stripping member rotates so as to facilitate the movement of the multiple sheets back toward the stack. Once the multiple sheets have been moved back toward the stack and beyond the stripping member, the controller may operate to cause the picking mechanism to again try to pick a single note from the stack.

In many existing automated banking machines produced by the assignee of the present invention, notes that are picked from the dispenser are moved through a transport of the type shown in U.S. Pat. No. 5,342,165, the disclosure of which is incorporated herein by reference. Such transports include a plurality of generally parallel and transversely disposed belt flights which move the notes in engagement therewith. Disposed between each adjacent pair of belt flights is a projecting member. The projecting member generally extends to at least the level of the sheet engaging surfaces of the adjacent belt flight. As a result sheets are captured in sandwiched relation between the projecting members and the belt flight. This sandwiching of the sheets causes the sheets to move with the moving belt flights to selected locations in the machine. For example as shown in the incorporated disclosure, the sheets are moved in engagement with the belt flight into a stack. Once the stack of sheets has been accumulated, the stack is engaged with belt flights so that it can be moved to be presented to a user of the machine.

The sheet dispenser mechanisms and transports described are highly reliable and have been used extensively in automated banking machines. However, problems can sometimes be encountered in the picking and transport of sheets. In some circumstances sheets may have relatively high surface tension and an affinity for adjacent sheets. This may prevent an end note from being readily separated from a stack of sheets. Alternatively an end note may be worn or soiled in a way that reduces its frictional properties. In such cases an end note may be more resistant to the forces of the high friction segment on the picking member and will not readily separate from the stack. In alternative situations the picking mechanism may be picking a type of sheet which is plasticized or otherwise has reduced frictional properties relative to the high friction segment on the picking member. In such circumstances picking the end note from a stack may prove more difficult to accomplish reliably.

Difficulties in picking sheets may also be encountered due to wear or malfunctions. After extended use the high friction segments on a picking member can become worn. This results in the segments providing less engaging force to move an end note. Alternatively or in addition, high friction segments may become soiled with use, which may also have the effect of reducing the frictional properties of the picking member. The currency canisters which hold the stack of notes also provide a biasing force to hold the end note in abutting relation with the picking member. As a result of damage or wear, the mechanism which provides the biasing force may not provide as great a force biasing the end note to engage the picking member as may be desirable to achieve highly reliable picking of sheets.

In circumstances where the picking member has difficulty picking a note, the note fails to move in coordinated relation with the high friction segments on the cylindrical portions of the picking member. The high friction segments may rotate past the end note leaving the end note generally in the stack. When this situation occurs the machine controller generally operates so that repeated attempts are made to pick the note. If the note cannot be removed from the stack, the machine may operate in accordance with its programming to provide notes from other supplies through other picking mechanisms within the machine. Alternatively the machine may indicate a malfunction and be placed out of service. In either case the extended transaction time or complete inability to carry out a user's transaction presents a significant inconvenience to the user of the machine.

In some alternative embodiments and circumstances notes or other media may be deformed by the action of the picking member and the stripping member. In such circumstances the leading edge of the note may be nicked and/or crumpled by engagement with the stripping member. Such deformed notes may prove difficult to handle in the machine. For example, the deformed portion of the note may be detected as a double note by a doubles detector within the machine. This may cause the note to be diverted as one not deliverable to a machine user. Alternatively such a note if detected as a double may be returned to the stack in an effort to separate the sensed double notes. The further picking and stripping action on the already deformed note may further exacerbate the problem.

Notes with less than optimum properties may also cause problems when being transported within the machine. Notes that have become wet or soiled may adhere to the projecting members and may fail to move with the belt flights in the transport. Notes that are slippery or have unduly low friction may not produce sufficient engaging force with the moving belt flights and may not move in coordinated relation with the belt flights. Likewise unduly worn or limp notes may not achieve normal engaging force with the belt flights and may become stuck or otherwise fail to move in a transport.

These conditions also present the potential for delaying a transaction or placing a machine out of service. The problem of notes sticking in a transport may also result in the misdispensing of notes. In some circumstances notes may be crumpled or damaged due to transport problems.

Thus there exists a need for improvements to picking mechanisms and sheet transports used in automated banking machines. There further exists a need for improvements to picking mechanisms and transports used in automated banking machines that can be readily installed in existing machines to facilitate use with notes and sheet types having a wider range of properties.

DISCLOSURE OF INVENTION

It is an object of an exemplary form of the present invention to provide an automated banking machine.

It is a further object of an exemplary form of the present invention to provide an automated banking machine with an improved system for picking sheets.

It is a further object of an exemplary form of the present invention to provide an automated banking machine with an improved system for picking and transporting sheets.

It is a further object of an exemplary form of the present invention to provide an automated banking machine which minimizes the crumpling and nicking of sheets during picking.

It is a further object of an exemplary form of the present invention to provide a method for picking sheets in an automated banking machine.

It is a further object of an exemplary form of the present invention to provide a method for transporting sheets in an automated banking machine.

It is a further object of an exemplary form of the present invention to provide a method for improving the operation of an automated banking machine.

It is a further object of an exemplary form of the present invention to provide a method for upgrading an existing machine to provide for improved picking of sheets.

It is a further object of an exemplary form of the present invention to provide a method for upgrading an existing automated banking machine to provide for improved transport of sheets.

Further objects of exemplary forms of the present invention will be made apparent in the following Best Modes For Carrying Out Invention and the appended claims.

The foregoing objects are accomplished in some exemplary embodiments by replacing the picking member in the prior art sheet dispenser mechanism with, or otherwise providing an alternate picking member that provides for applying additional force to move a sheet from a stack in situations where the sheet does not move with the picking member. In the exemplary embodiment the sheets which are picked through operation of the picking member are notes that are picked from a stack. The stack is bounded by an end note which engages the picking member.

A first alternative picking member includes at least one movable engaging portion. The movable engaging portion is movable relative to the rotating picking member. The alternate picking member operates so that when the picking member rotates about its axis to pick a note, the engaging portion is in engagement with the end note being picked. In circumstances where the picking member rotates such that the movement of the picking member exceeds the movement of the end note, the engaging portion moves further radially outward relative to the picking member. This outward movement of the engaging portion applies increasing engaging force to the end note. This increasing engaging force results in additional force tending to move the end note relative to the stack.

An exemplary form of the first alternate picking member includes a cam surface and a cam follower portion. The cam follower portion is operatively connected to the engaging portion. The action of the cam surface and cam follower portion operates to cause the engaging portion to move radially inward when necessary, before the engaging portion passes adjacent to the stripping member. This reduces the risk of the engaging portion colliding with the stripping member and prevents damage to the dispenser mechanism as well as to notes that are moved therethrough.

In a further alternative exemplary embodiment a picking member is provided with a high friction arcuate segment. A stripping member is positioned in opposed engaging relation so as to be biased towards the picking member and the high friction arcuate segment. The exemplary form of the picking member includes at least one low friction, arcuate projecting portion arcuately aligned with a leading portion of the high friction segment and axially transversely disposed from the stripping member. In an exemplary embodiment the low friction, arcuate projecting portion engages the end note being picked so as to provide support for the note in a support area transversely adjacent to the stripping area which reduces the tendency to nick or crumple notes due to action of the stripping member.

An alternative exemplary embodiment further includes a sheet transport for transporting notes or sheets that have been dispensed from the dispenser mechanism. The sheet transport includes a plurality of belts which include a plurality of generally parallel transversely spaced belt flights. Projecting member portions extend generally parallel and intermediate of the belt flights. This configuration enables sheets to move in sandwiched relation between the belt flights and the projecting member portions. To provide more reliable movement of sheets, at least one of the conventional belts is replaced with an alternate belt. While the conventional belts have a generally smooth continuous sheet engaging surface, the exemplary form of the alternate belt includes at least one and preferably a plurality of, projections that extend from the sheet engaging surface of the belt. As a result, sheets which become stuck due to adhesion to the projecting member portions will be engaged by the projections and urged to move in the transport. Similarly sheets which do not have sufficient frictional engagement with the belt flights to be moved along the transport, are engaged by the projections and urged to move therewith. This minimizes the risk that sheets will become hung up in the transport and results in higher reliability of the machine.

The exemplary forms of the picking member and belt may be installed in new machines or in existing automated banking machines without further substantial modifications to the machines. This may enable enhancing machine reliability quickly and at a modest cost.

BEST MODES FOR CARRYING OUT INVENTION

Figure 1:
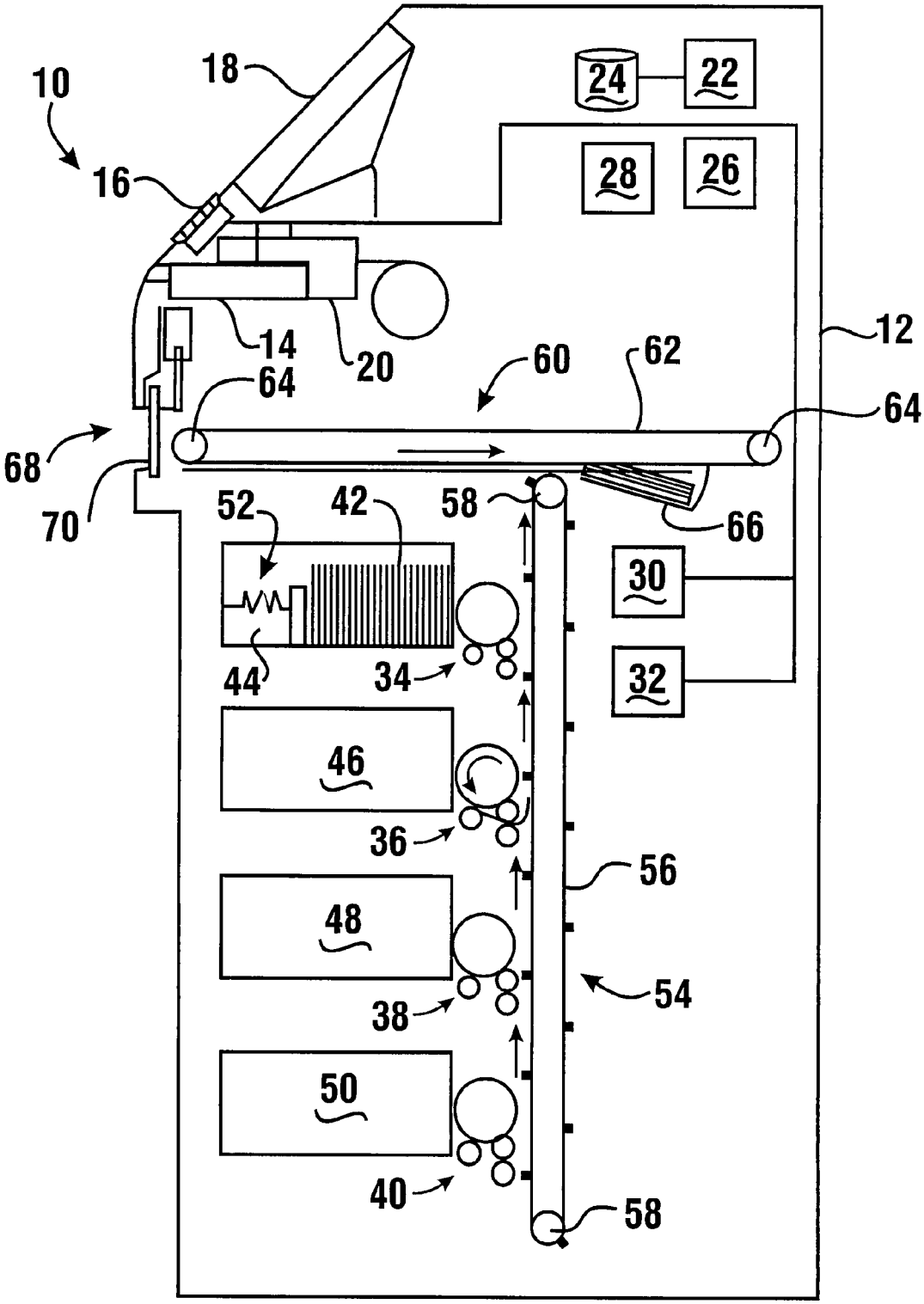
FIG. 1 is a side schematic view of an automated banking machine incorporating a first exemplary embodiment.

Referring now to the drawings and particularly FIG. 1, there is shown therein an exemplary embodiment of an automated banking machine generally indicated 10. In the exemplary embodiment machine 10 is an ATM. However it should be understood that the invention may be used in connection with other types of automated transaction machines and banking machines.

Automated banking machine 10 includes a housing 12 which houses certain components of the machine. The components of the machine include input and output devices. In this exemplary embodiment the input devices include a card reader schematically indicated 14. Card reader 14 is operative to read a customer's card which includes information about the customer thereon, such as the customer's account number. In some embodiments the card reader 14 may be a card reader adapted for reading magnetic stripe cards and/or so-called "smart cards" which include a programmable memory. Another input device in the exemplary embodiment are input keys 16. Input keys 16 may in embodiments of the invention, be arranged in a keypad or keyboard. Input keys 16 may alternatively or in addition include function keys or other types of devices for receiving manual inputs. It should be understood that in various embodiments other types of input devices may be used such as biometric readers, speech or voice recognition devices, inductance type readers, IR type readers, and other devices capable of communicating with a person, article or computing device, radio frequency type readers and other types of devices which are capable of receiving information that identifies a customer and/or their account.

The exemplary embodiment of machine 10 also includes output devices providing outputs to the customer. In the exemplary embodiment machine 10 includes a display 18. Display 18 may include an LCD, CRT or other type display that is capable of providing visible indicia to a customer. In other embodiments output devices may include devices such as audio speakers, RF transmitters, IR transmitters or other types of devices that are capable of providing outputs which may be perceived by a user either directly or through use of a computing device, article or machine. It should be understood that some embodiments may also include combined input and output devices such as a touch screen display which is capable of providing outputs to a user as well as receiving inputs.

The exemplary embodiment of the automated banking machine 10 also includes a receipt printer schematically indicated 20. The receipt printer is operative to print receipts for users reflecting transactions conducted at the machine. Embodiments may also include other types of printing mechanisms such as statement printer mechanisms, ticket printing mechanisms, check printing mechanisms and other devices that operate to apply indicia to media in the course of performing transactions carried out with the machine.

Automated banking machine 10 further includes one or more controllers schematically indicated 22. Controller 22 includes one or more processors that are in operative connection with one or more data stores or memory schematically indicated 24. The controller is operative to carry out programmed instructions to achieve operation of the machine in accomplishing transactions. As schematically indicated, the controller is in operative connection with a plurality of the transaction function devices included in the machine.

The exemplary embodiment includes at least one communications device 26. The communications device may be one or more of a plurality of types of devices that enable the machine to communicate with other systems and devices for purposes of carrying out transactions. For example communications device 26 may include a modem for communicating messages over a data line or wireless network, with one or more other computers that operate to transfer data representative of the transfer of funds in response to transactions conducted at the machine. Alternatively the communications device 26 may include various types of network interfaces, line drivers or other devices suitable to enable communication between the machine 10 and other computers and systems.

Machine 10 also includes a plurality of sensing devices for sensing various conditions in the machine. These various sensing devices are represented schematically by component 28 for simplicity and to facilitate understanding. It should be understood that a plurality of sensing devices are provided in the machine for sensing and indicating to the controller 22 the status of devices within the machine.

Automated banking machine 10 further includes a plurality of actuators schematically indicated 30 and 32. The actuators may comprise a plurality of devices such as motors, solenoids, cylinders, rotary actuators and other types of devices that are operated responsive to the controller 22. It should be understood that numerous components within the automated banking machine are operated by actuators positioned in operative connection therewith. Actuators 30 and 32 are shown to schematically represent such actuators in the machine and to facilitate understanding.

In the exemplary automated banking machine 10 there are four sheet dispenser mechanisms 34, 36, 38 and 40. Each sheet dispensing mechanism is operative responsive to the controller 22 to pick sheets. Sheets may be selectively picked generally one at a time from a stack of sheets such as stack 42 shown adjacent to sheet dispenser mechanism 34. In the exemplary embodiment each of the stacks of sheets associated with a respective sheet dispenser mechanism is housed in a canister. A canister 44 houses sheets in connection with dispenser mechanism 34. Likewise a canister 46 houses sheets to be picked by dispenser mechanism 36. A canister 48 houses sheets dispensed by dispenser mechanism 38 and a canister 50 houses sheets that are dispensed by dispenser mechanism 40. As schematically represented in canister 44, the stack of sheets 42 is biased to engage the sheet dispenser mechanism by a biasing mechanism 52.

In the exemplary embodiment, canisters 44, 46, 48 and 50 are used to house sheets having predetermined value such as bank notes. Such bank notes may be of various denominations which enable dispensing money in varying amounts to customers. Alternatively one or more of the canisters may hold other types of sheets such as coupons, scrip, tickets, money orders or other items of value. The controller operates the dispenser mechanism selectively in response to customer inputs and information from systems with which the machine communicates, to cause sheets to be selectively dispensed from the canisters.

Notes that are dispensed from the canisters in the exemplary embodiment are engaged with a first note transport schematically indicated 54. First note transport 54 which is later described in detail, includes a plurality of continuous belts 56. The belts extend around sets of rollers 58 which operate to drive and guide the belts. As shown schematically in FIG. 1 by the sheet dispensed from dispenser mechanism 36, sheets are enabled to engage the adjacent flights of belts 56 and move in engagement therewith upward to a second transport 60.

The second transport 60 in the exemplary embodiment may be similar to that shown in U.S. Pat. No. 5,342,165 the disclosure of which is incorporated by reference as if fully rewritten herein. Transport 60 also includes a plurality of continuous belts 62 which extend about sets of rollers 64. Rollers 64 operate to drive the belt 62 such that notes passing upward in transport 54 initially engage flights of belt 62 and are collected into a stack 66. In response to operation of the controller 22 when a desired number of notes have been collected in the stack 66, the stack is moved in the manner of the incorporated disclosure and the belts 62 are driven so that the stack 66 is moved toward a user opening 68 in the housing 12 of the machine. As the notes are moved toward the opening 68, the controller operates a suitable actuating device to operate a gate 70 so as to enable the stack to pass outward through the opening. As a result the user is enabled to receive the sheets from the machine. After a user is sensed as having removed the stack from the opening, the controller may operate to close the gate 70 so as to minimize the risk of tampering with the machine.

It should be understood that the devices shown in connection with exemplary automated banking machine 10 are representative of devices that may be found in such machines. Numerous additional or alternative types of devices such as deposit accepting devices, document reading devices, currency accepting devices, ticket printing devices and additional devices may be included in automated banking machines which are used in connection with alternative embodiments.

Figure 14:
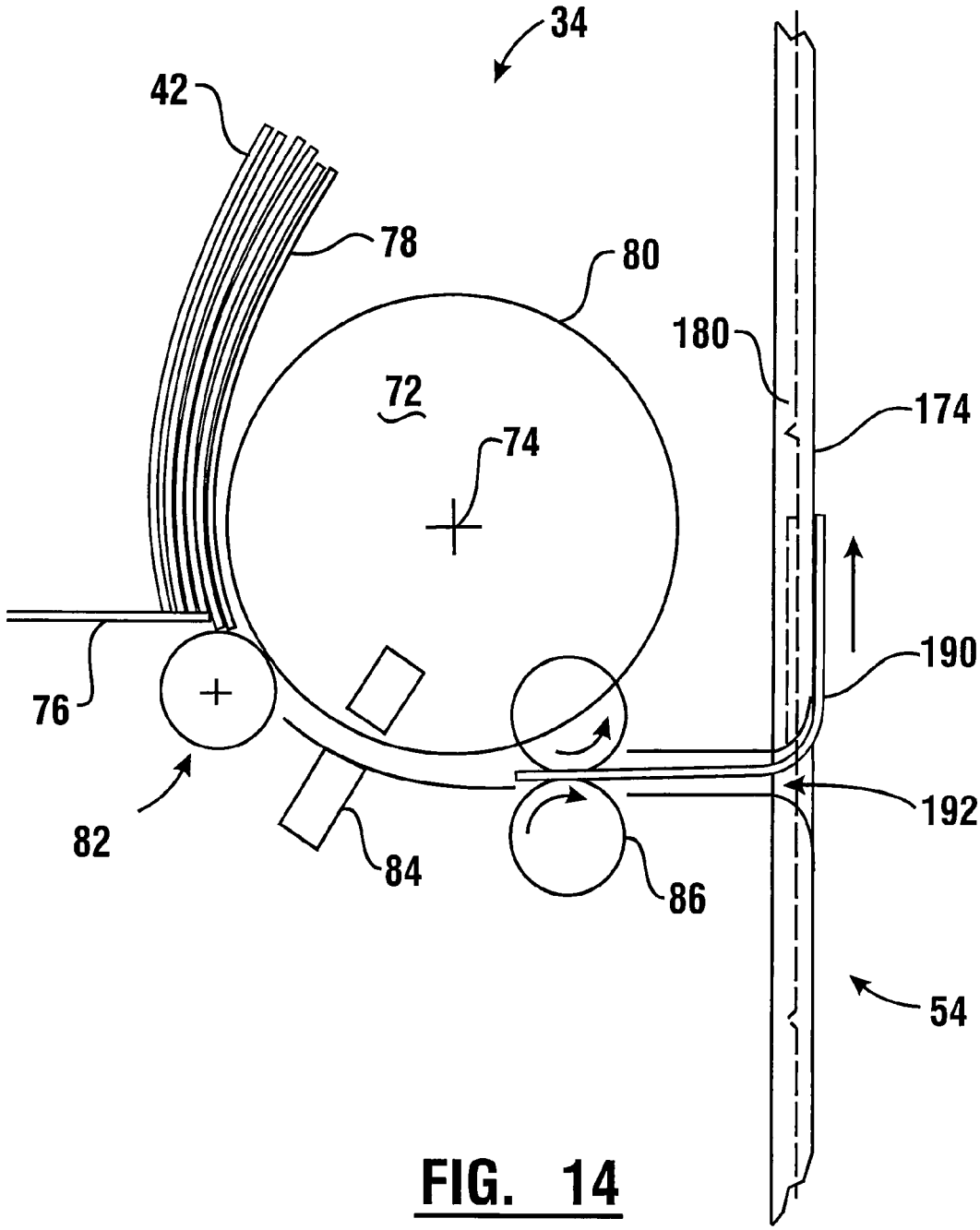
FIG. 14 is a side schematic view showing a sheet that has been dispensed by a dispenser mechanism moving to engage a sheet transport.

FIG. 14 shows a first sheet dispenser mechanism 34 in greater detail. In the exemplary embodiment of the machine 10 all the dispenser mechanisms may be the same, or different types of sheet dispenser mechanisms may be used. Dispenser mechanism 34 includes a picking member 72. The picking member 72 is selectively rotated responsive to the controller 22 about an axis 74. Bank notes or other sheets in the stack 42 are supported by a supporting surface 76 which terminates in the area adjacent to the picking member. An end note 78 bounds the stack adjacent to the picking member 72. During each rotation of the picking member the then current end note bounding the stack is moved and delivered from the stack and passed to the transport 54.

The picking member 72 has an outer bounding surface 80. The outer bounding surface 80 is in generally abutting relation with stripping members 82 which are alternatively referred to herein as stripper members or strippers. As previously discussed the stripping members 82 in the exemplary embodiment do not rotate in a clockwise direction as shown in FIG. 14. In the exemplary embodiment, the stripping members 82 will however rotate in a counterclockwise direction due to action of associated one-way clutches as later described.

Positioned downstream of the stripping members 82 is a doubles detector 84. Doubles detector 84 may be a mechanical sensor, radiation sensor, sonic sensor or other type sensor that is suitable for determining if single or multiple notes have moved past the stripping member toward the transport. Downstream of the doubles detector are a pair of carry away rolls 86. The carry away rolls are operative to engage sheets that have moved sufficiently away from the stack so as to engage the rolls. The rolls which are operated by a drive in response to the controller 22, operate to engage sheets and move them into the transport. It should be understood that this configuration of the dispenser mechanism is exemplary and in other embodiments different configurations may be used.

As discussed in the incorporated disclosure of U.S. Pat. No. 5,577,720, the normal operation of the dispenser mechanism involves the picking member rotating responsive to the controller 22 during picking operations. When it is desired to pick the end note 78, the picking member 72 rotates in a counterclockwise direction as shown in FIG. 14 about the axis 74. This is done through operation of a drive or other similar device. Rotation of the picking member urges the end note 78 to move from the stack. The stripping members 82 resist the movement of the end note because the stripping members do not move in a clockwise direction as shown in FIG. 14. Because of the surface area of the picking member 72 engaging the end note and the frictional properties of the outer bounding surface 80, the force urging the end note 78 to move from the stack generally overcomes the resistance force of the stripping members. This is because the stripping members have a smaller surface area and/or a different frictional coefficient resulting in less resistance force than the moving force of the picking member. The stripping members however provide sufficient resistance to resist generally all but the end note 78 from moving from the stack. This is because the notes in the stack other than the end note, are not directly engaged with the picking member and do not experience the same degree of force urging them to move from the stack.

As the end note 78 is moved from the stack the thickness thereof may be sensed by the doubles detector 84. The doubles detector 84 is operatively connected to the controller and at least one signal from the doubles detector provides an indication as to whether a single or a multiple note has been pulled from the stack. In circumstances where multiple notes are sensed, the controller may cause the picking member to operate to stop rotating in the counterclockwise direction as shown in FIG. 14, and instead to rotate in a clockwise direction. When the picking member 72 rotates in a clockwise direction to pull sheets back into the stack 42, the exemplary stripping members 82 are enabled to cooperatively rotate in a counterclockwise direction as shown in FIG. 14. This is due to the one-way clutch associated with each of the stripping members. As a result the sheets are returned to the stack. Thereafter the controller 22 may again operate so as to rotate picking member 72 in a counterclockwise direction and an attempt is again made to pick a single end note from the stack.

In circumstances where the doubles detector 84 senses only a single note passing from the stack, the controller operates a drive or other suitable moving mechanism to cause the carry away rolls 86 to engage and move the sheet to the transport 54. It should be understood that the steps described as being taken responsive to operation of the controller are exemplary. In some embodiments of the invention the controller may cause the machine to operate to direct double notes to a divert bin or other storage area rather than attempting to repeatedly pick a single note.

Figure 2:
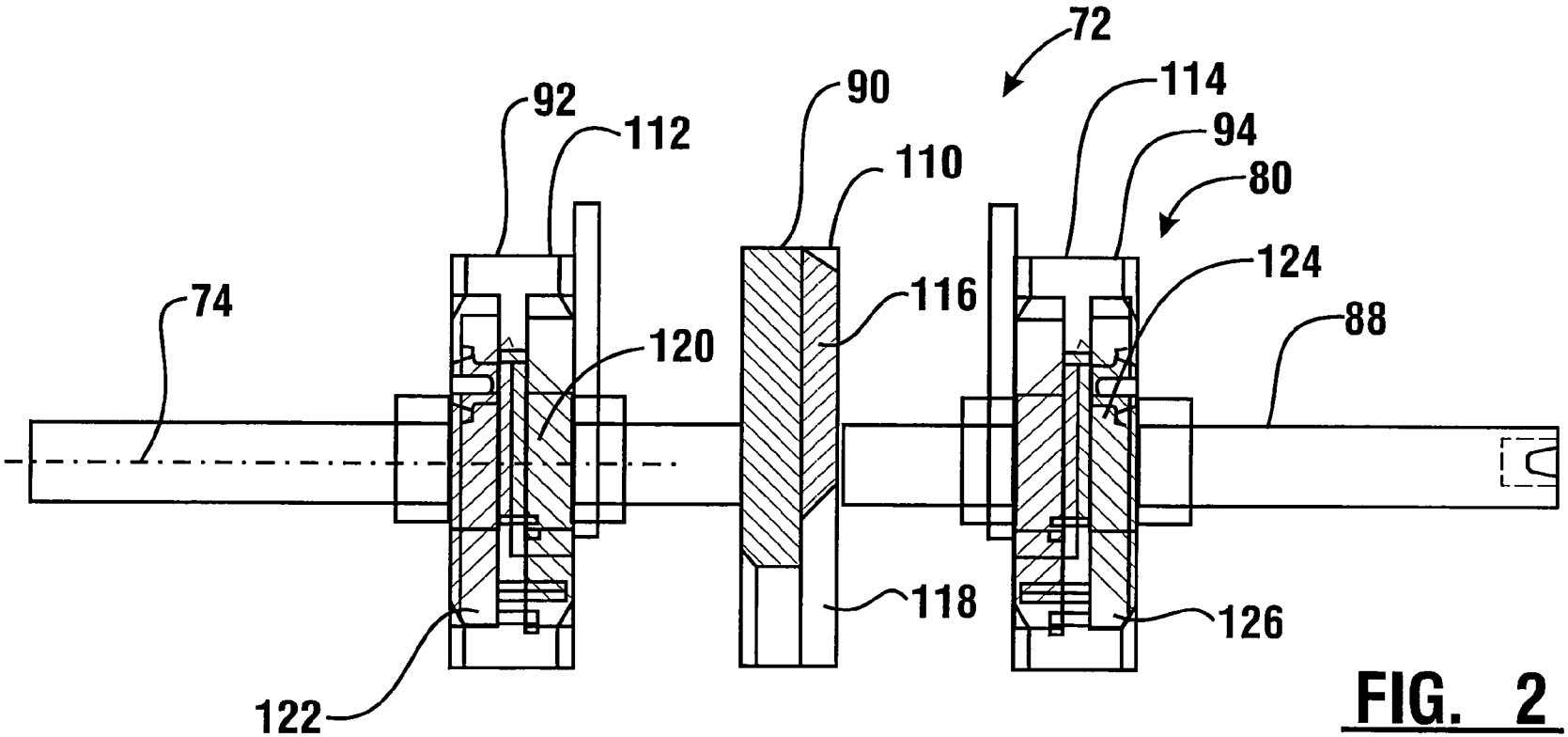
FIG. 2 is a side view of a picking member used in the first exemplary embodiment.
Figure 3:
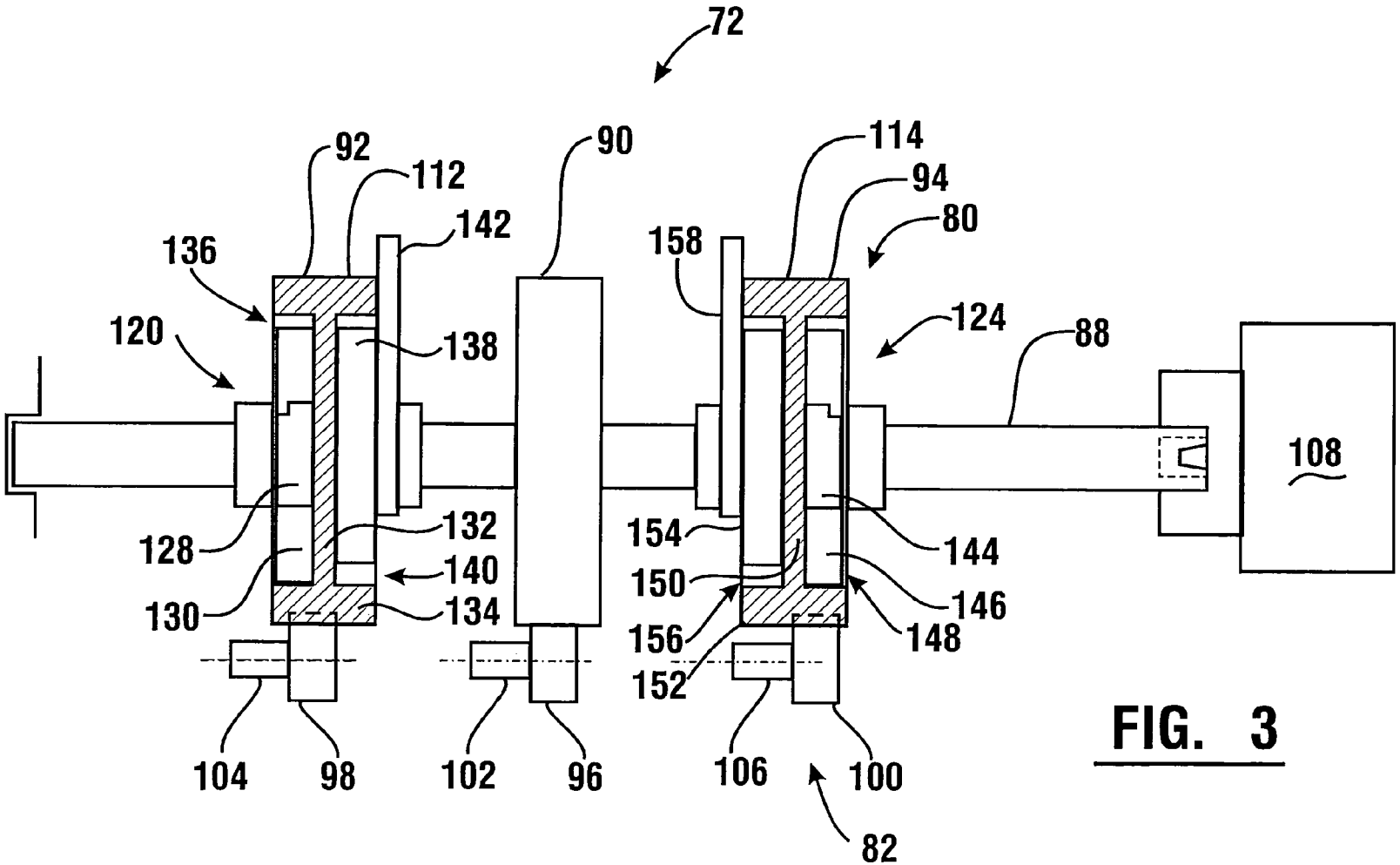
FIG. 3 is a cross sectional view of the picking member shown in FIG. 2 in operative connection with a drive in the machine.

The picking member of the first exemplary embodiment of the present invention is shown in greater detail in FIGS. 2 and 3. The picking member 72 includes a central shaft 88. Three separated cylindrical portions are supported on the shaft. These cylindrical portions include a central portion 90. Disposed on a first axial side of cylindrical portion 90 is a first outboard portion 92. Disposed in an opposed axial direction from central cylindrical portion is a second outboard portion 94.

As shown in FIG. 3 each cylindrical portion 90, 92 and 94 has an associated one of the stripping members 82 in abutting relation therewith, indicated 96, 98 and 100 respectively. Each of the stripping members has an associated one-way clutch 102, 104 and 106 operatively connected therewith. Each of the one-way clutches as previously discussed, enables only one-way rotation of the stripping member. The stripping member is enabled to rotate only when sheets are being pulled back into the stack. However when sheets are being picked the stripping members remain generally stationary.

As shown schematically in FIG. 3, shaft 88 is operatively connected with a drive 108 which selectively rotates the shaft responsive to signals from the controller. As also shown in FIG. 3, in the exemplary embodiment stripping member 96 which is in abutting relation with the central portion 90 is somewhat angularly disposed from stripping members 98 and 100 which are in abutting relation with the outboard portions 92 and 94 respectively. In the exemplary form of the invention, stripping member 96 is disposed somewhat angularly forward of the other stripping members such that notes tend to engage the central stripping member during picking prior to engaging stripping members 98 and 100. Of course in other embodiments other approaches, configurations and types of stripping members and picking members may be used. Further as later discussed in connection with an alternative embodiment, not all cylindrical portions may operate in conjunction with opposed stripping members.

As shown in FIG. 2 the outer bounding surface 80 of the picking member includes an outer surface 110 of cylindrical portion 90, as well as outer surface 112 of cylindrical portion 92 and outer surface 114 of cylindrical portion 94. Outer surface 110 includes thereon a ribbed relatively high friction portion 116. The balance of the outer surface 110 has a relatively lower friction portion 118. High friction portion 116 applies an engaging force to the end note bounding the stack which is generally sufficient to engage and move the end note from the stack. The low friction portion 118 is generally enabled to move relative to the end note without causing the note to be moved from the stack. In the exemplary embodiment this construction facilitates reliably picking a single note each time the picking member is rotated one turn. This construction further provides spacing between notes sequentially picked from the stack. Such spacing facilitates identifying and handling of notes.

Outer surface 112 of cylindrical portion 92 likewise includes a ribbed, relatively high friction portion 120 on the outer surface thereof. Outer surface 112 also includes a relatively lower friction portion 122 which surrounds the high friction portion. The angular position of high friction portion 120 generally corresponds to high friction portion 116 on the central portion 90. As is the case with the other relatively high and low friction portions, high friction portion 120 applies force to the end note generally sufficient to engage and move it from the stack, while the relatively lower friction portion is enabled to move in engagement with the end note without causing it to be disposed from the stack. Similarly as shown in FIG. 2 cylindrical portion 94 also includes a generally high friction portion 124 and a generally lower friction portion 126. The high and low friction portions on the cylindrical portion 94 angularly correspond to the high and low friction portions on the other cylindrical portions of the picking member.

As most clearly shown in the partial cross sectional view in FIG. 3, within the high friction portion 120 of cylindrical portion 92, is an arcuate segment 128. Arcuate segment 128 occupies a portion of the axial width of the cylindrical portion toward the outboard side of the picking member. The arcuate segment 128 is supported on a movable member 130. Movable member 130 as later discussed in detail, is movable relative to the cylindrical portion and the picking member in a manner which enables arcuate segment 128 to move radially outward relative to the bounding surface bounding the picking member. In the exemplary embodiment the cylindrical portion 92 is generally I-shaped in transverse cross section and includes a central web portion 132. The web portion 132 terminates in cross section in a flange portion 134 which supports the outer surface 112 thereon. The movable member 130 is movable in a recess 136 on a first longitudinal side of the web member 132.

A cam 138 is positioned in a recess 140 which extends on opposed longitudinal side from recess 136. Cam 138 is in supporting connection with the shaft 88. Cam 138 is also in supporting connection with a support member portion 142. The support member portion 142 operates to hold the cam 138 stationary as the shaft 88 and cylindrical portion 92 rotates.

Cylindrical portion 94 includes structures which are generally a mirror image of those associated with cylindrical portion 92. The high friction portion of outer surface 114 includes an arcuate segment 144 which is supported on a movable member 146. The movable member 146 is positioned in a recess 148 which is bounded by a web portion 150 and a flange portion 152 of cylindrical portion 94.

A cam 154 is positioned in a recess 156 on an opposed longitudinal side from recess 148. Cam 154 is in supporting connection with the shaft 88 and is held stationary relative to the shaft by a support member portion 158.

Figure 4:
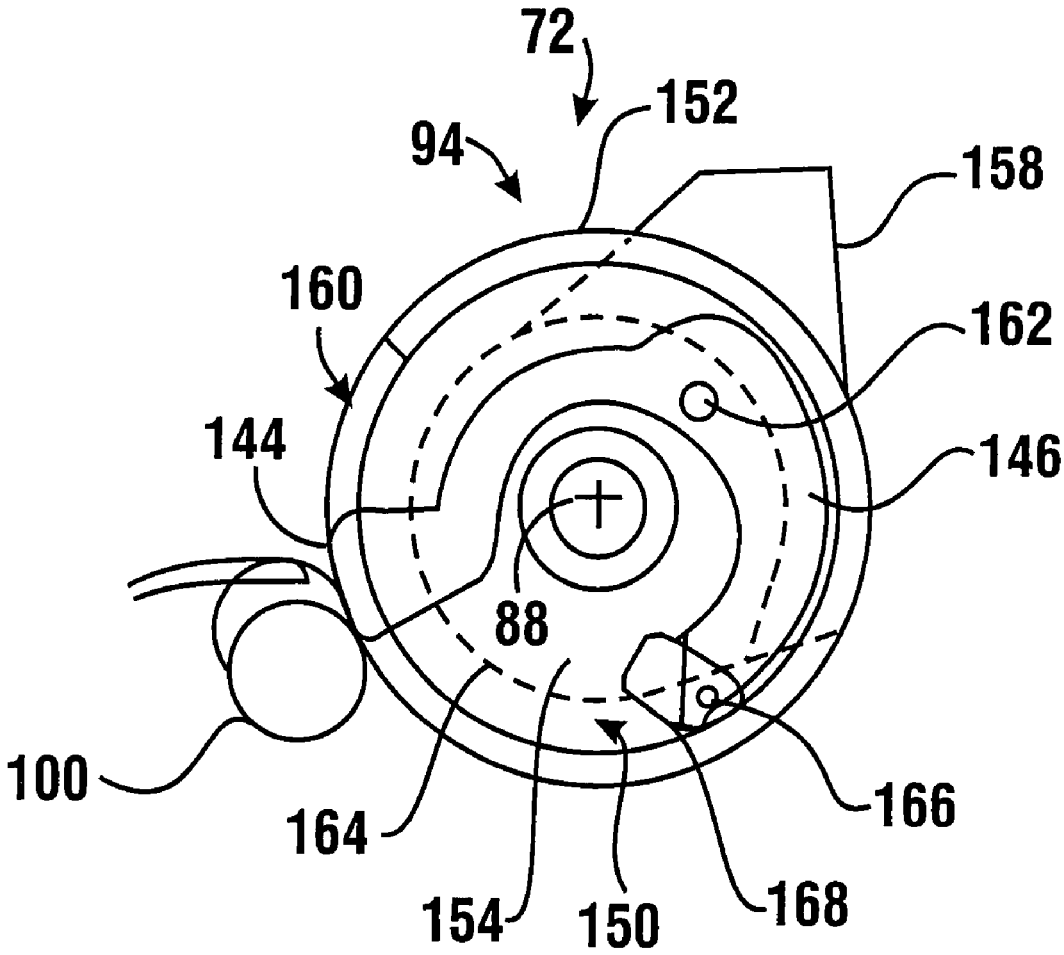
FIG. 4 is a side view of the picking member shown in FIG. 3.

As the operation of the cylindrical portions 92 and 94 of the picking member are similar, an explanation of the operation of the picking member will be described with reference to cylindrical portion 94. As best seen in FIG. 4, the segment 144 extends through an opening 160 in the flange portion 152 of cylindrical portion 94. The exemplary movable member 146 is generally horseshoe shaped and is supported on the picking member through a pivot connection 162. The pivot connection supports the movable member 146 through the web portion 150.

The cam 154 is bounded by a cam surface 164. A cam follower portion 166 is supported on the movable member 146 at an end opposed of the arcuate segment 144. The cam follower portion extends through an opening 168 in the web portion 150. This enables the cam follower portion 166 to engage the cam surface 164 of the cam 154. As can be appreciated, this arrangement enables the position of the arcuate segment 144 to be controlled as the picking member rotates due to the engagement of the cam follower 166 with the cam surface 164.

Figure 5:
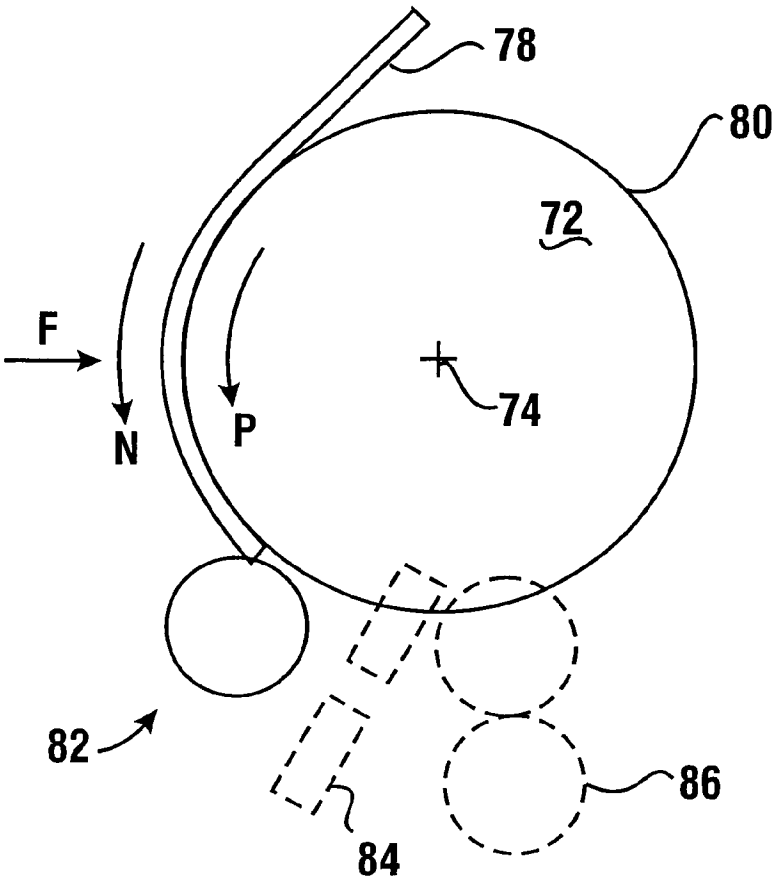
FIG. 5 is a side schematic view of the picking member operating to move an end note from the stack in circumstances where the end note moves in coordinated relation with the picking member.

The overall operation of the exemplary picking member 72 is explained with reference to FIGS. 5 and 6. As indicated in FIG. 5, during normal operation of the picking member the high friction portions on the picking members engage an end note 78 bounding the stack. The high friction portions move the note generally engaged and at the same speed as the picking member, past the stripping member 82 so that the end note is moved from the stack. During this normal operation the note moves in synchronized relation with the movement of the outer bounding surface 80 of the picking member 82. As a result during normal operation the velocity of the end note indicated by arrow N corresponds generally to the velocity of the outer surface 80 of the picking member represented by arrow P. Arrow F corresponds to the direction of the force applied to the stack which holds the end note 78 in engaged relation with the picking member 72.

Figure 6:
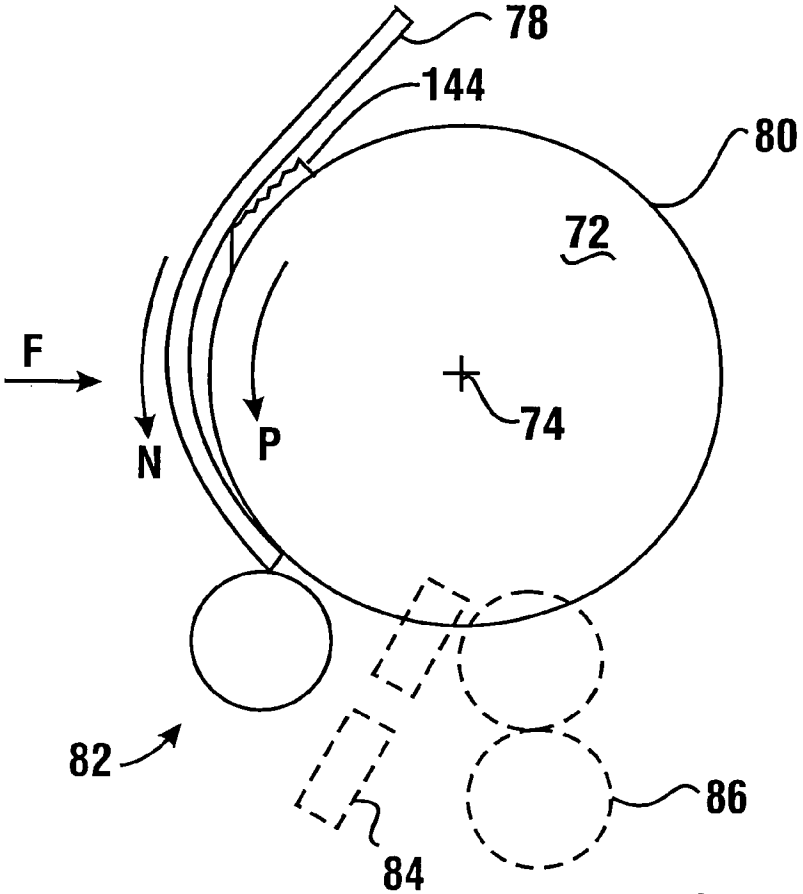
FIG. 6 is a view similar to FIG. 5 but showing the movement of the engaging portion of the picking member radially outward responsive to the picking member moving in a picking direction without corresponding movement of the end note.

FIG. 6 represents the operation of the picking member 72 of the first exemplary embodiment when an end note 78 fails to move in coordinated relation with the picking member. In such circumstances the velocity and displacement of the picking member is greater than the corresponding velocity and movement of the end note 78. The high friction arcuate segments 128, 144 which serve as engaging portions, because they are enabled to move relative to the picking member 72, tend to maintain engaged relation with the end note. This is represented by the arcuate segment 144 in FIG. 6. Because the engaging portion of the arcuate segment 144 remains engaged with the end note and is movable relative to the picking member, when the angular movement of the picking member exceeds the movement of the engaging portion of segment 144, the segment 144 moves radially outward relative to outer bounding surface 80. The movement of the engaging portion further radially outward relative to the axis of rotation 174 increases the engaging force on the end note urging it to move from the stack. As can be appreciated from the later detailed description of the movable member, the engaging portions tend to move further radially outward providing increasing engaging force, with an increase in difference between the movement of the picking member and the engaging portion. This increasing force on the end note tends to cause the end note to begin moving past the stripping members 82 so that the note can be picked. As the end note begins to move in coordinated relation with the picking member, the engaging portions may begin to move radially inward. In the exemplary embodiment the action of the cam follower portion and the cam surface operate to assure that the engaging portions are moved radially inward to the level of the outer bounding surface 80 by the time the engaging portions rotate to a position adjacent to the stripping members 82. This assures that the engaging portions and the notes are not damaged.

Figure 7:
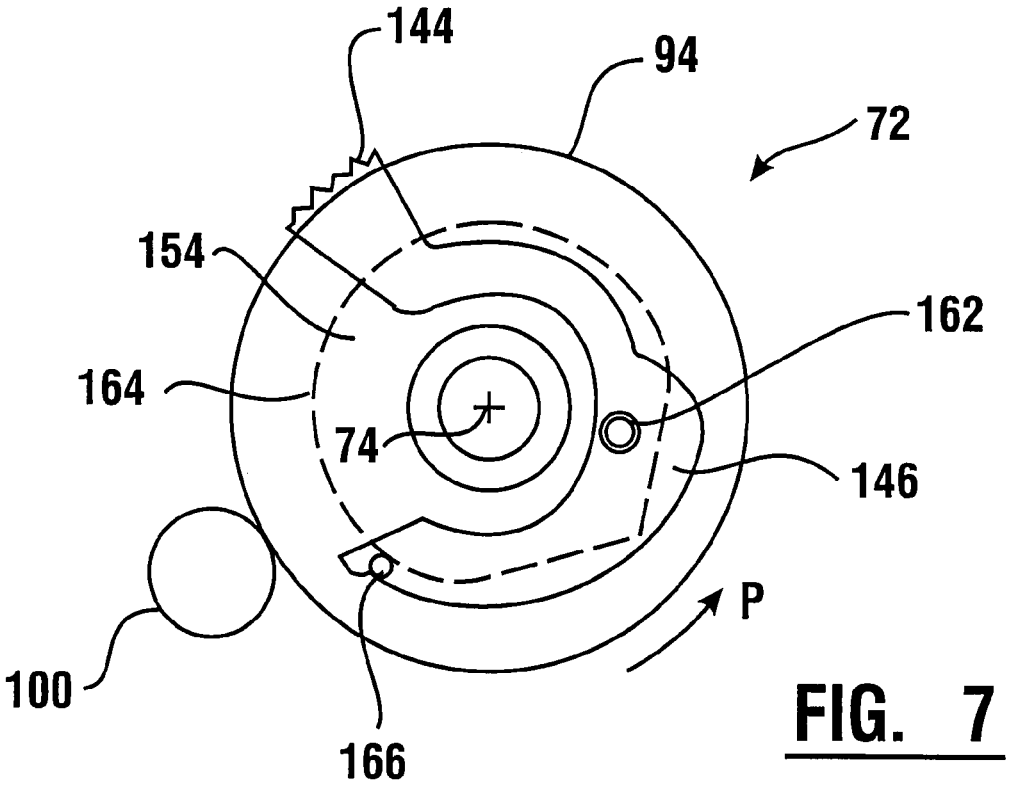
FIGS. 7-10 are side schematic views showing a sequence of positions of the engaging portion of the picking member and the operation of the cam surface to retract the engaging member as the picking member rotates.

FIGS. 7-10 show the exemplary operation of the picking member 72 with regard to cylindrical portion 94 of the picking member. It should be understood that cylindrical portion 92 is a mirror image thereof and works in a similar manner during picking. As represented in FIG. 7, the picking member 72 rotates in the direction of arrow P. Assuming that an end note engaged with the engaging portion which is included on segment 144 is not moving in synchronization with the picking member, the segment 144 rotates in a first direction about pivot connection 162. This results because the segment 144 is engaged with the note and the angular movement thereof does not correspond to the angular movement of the picking member 72 about the axis 74. Segment 144 moves radially outward relative to axis 74. The radially outward movement of segment 144 is limited by the engagement of the cam follower portion 166 with the cam portion 164 of cam 154.

As can be appreciated, the outward movement of the engaging portion on segment 144 applies increasing engaging force on the end note responsive to the end note not moving with the picking member. In addition the engaging portion of segment 144 operates to move further radially outward with an increasing difference between the movement of the picking member and the movement of the note. This outward movement may continue until the segment 144 reaches the full extent of its travel as limited by the cam surface.

Figure 8:
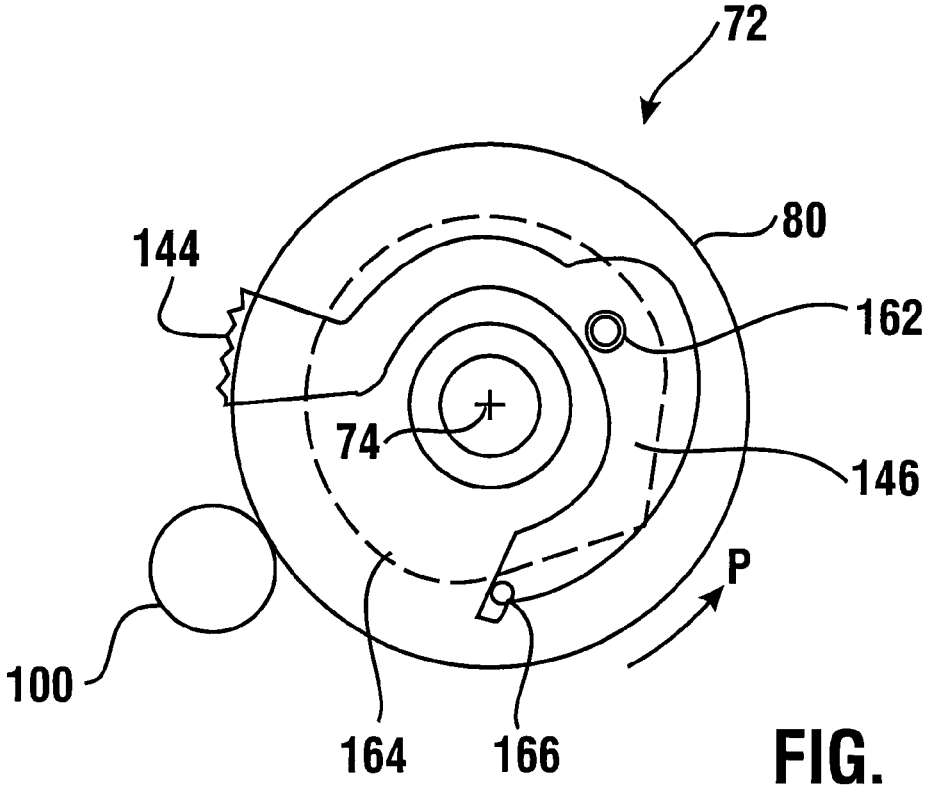

As shown in FIG. 8, if the end note has not initially moved in coordinated relation with the picking member, the engaging portion of the arcuate segment 144 will generally remain extended radially outward relative to the outer bounding surface of the picking member as the picking member further rotates. This provides additional force tending to assure that the note is moved from the stack. It should be appreciated that once the note begins moving, if note movement begins to exceed that of the picking member, the engaging portion of the arcuate segment 144 will begin to retract radially inward toward the outer bounding surface 80. Generally however once the engaging portion has extended radially outward, it will remain outwardly extended to the extent permitted by the engagement of the cam follower portion 166 with the cam surface 164.

Figure 9:
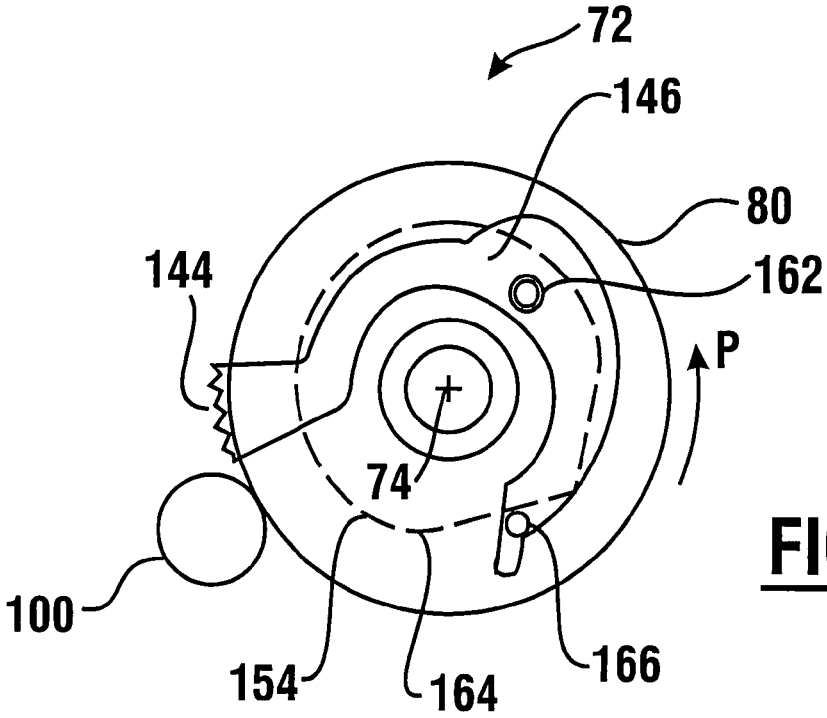

As shown in FIG. 9, as the picking member 72 rotates further toward the position where the engaging portion of the arcuate segment 144 approaches the stripping members, the profile of the cam surface 164 causes the cam follower portion 166 to cause the movable member 146 to rotate relative to the pivot connection 162. As shown in FIG. 9 the cam surface tends to rotate the movable member 146 in a generally opposed rotational direction about pivot connection 162, a direction in which the movable member rotates to extend the arcuate segment. As a result, as the picking member rotates so that the arcuate segment approaches the stripping member, the arcuate segment tends to move radially inward toward the outer bounding surface 80.

Figure 10:
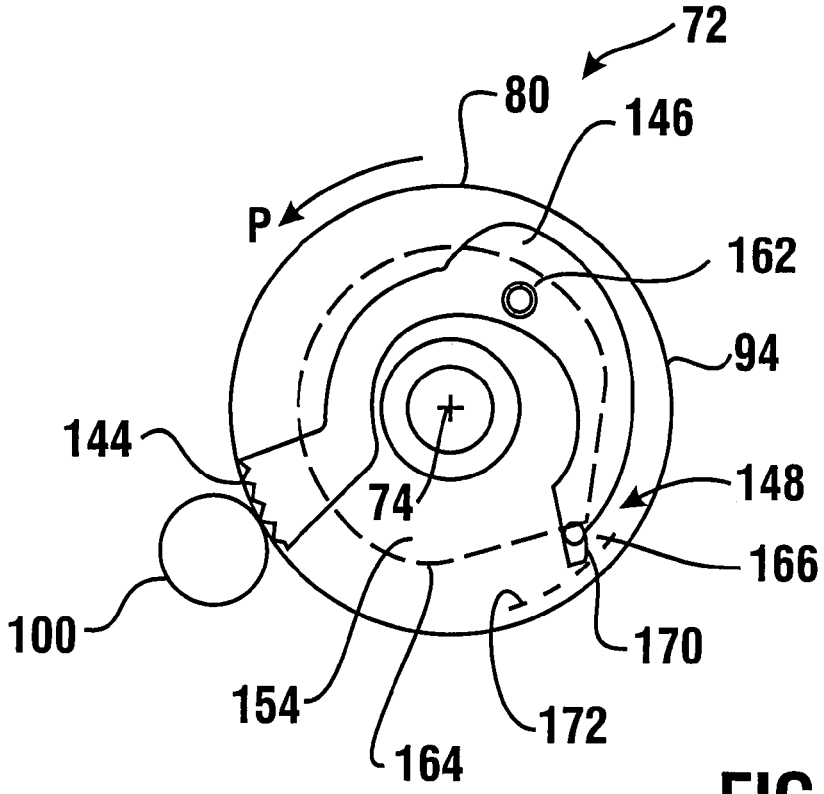

As shown in FIG. 10 once the picking member 72 has rotated to the point where the engaging portion of segment 144 is in abutting relation with the stripping member, the operation of the cam surface 164 and the cam follower portion 166 has caused the engaging portion to be retracted through movement of the movable member 146. The outer surface of segment 144 at this point is moved to generally conform with the outer bounding surface 80 of the picking member. In addition as the engaging portion on the segment 144 retracts radially inward, the engaging portion applies a decreasing engaging force to the end note as the end note is moved between the picking member and the stripping member. This decreasing force not only avoids collisions between the engaging portion and the stripping members, but it also prevents possible damage to the mechanism as well as to the notes being picked.

As shown in FIG. 10 the exemplary embodiment includes a stop portion 170 on the movable member 146. The stop portion 170 engages a surface 172 bounding recess 148. The stop portion prevents the engaging portion on the segment 144 from being moved radially inward substantially beyond the outer bounding surface 80 of the picking member.

As can be appreciated this exemplary embodiment of the picking member provides increasing engaging force on the end note responsive to the end note not moving with the picking member. As a result additional picking force is applied in only those circumstances where it is required to move the end note from the stack. In circumstances where notes are soiled, have high surface tension or are of slippery consistency, additional moving force is usually automatically applied. Further this exemplary form of the picking member also enables compensating for wear or reduced friction with soiling that may result from extended use of a picking member. In this way the exemplary form of the picking member is able to compensate for those conditions which might otherwise result in a decrease in note picking reliability.

It should further be understood that while in the exemplary form of this picking member the engaging portion is moved radially outward and applies additional picking force based on the relative movement between the end note and the picking member, in other embodiments other approaches may be used. Such approaches may include for example, other devices and systems for determining a difference in relative movement between the notes being picked and the picking member, and moving in engaging portion to apply additional engaging force in response thereto. Although the exemplary form of the invention uses a mechanical type system to accomplish this, electronic and electromechanical systems may be used in other embodiments.

A further useful aspect of the exemplary form of the first embodiment of the picking member and its operation in connection with dispensing mechanisms, is that it may be readily retrofit to an existing automated banking machine. The exemplary form enables a service technician to access an interior area of an ATM such as by unlocking a door to a secure chest portion. Once access is gained to the note handling mechanism, the technician may remove an existing picking member which does not include the features of the radially movable engaging portions, and to install a picking member 72 in place thereof. In the exemplary embodiment the support member portions 142 and 158 are configured to engage existing surfaces within the housing of the ATM so as to hold the cams stationary as the picking member rotates. Once installed in the ATM, the door to the secure chest portion is closed and locked.

Picking member 72 is constructed to have the same general profile as picking members that do not incorporate the exemplary enhanced picking features. Thus, installation of the exemplary picking member is readily made to improve the operation of the machine. It should further be understood that the programming of the controller 22 also often need not be changed to accommodate the installation of the picking member 72. Except as described herein, the operation of the picking member 72 is similar to that of a picking member which may be replaced in terms of moving and retracting notes.

Alternative embodiments of the automated banking machine may include other types of sheet dispensing mechanisms. Features of an alternative sheet dispensing mechanism 210 are described in connection with FIGS. 19-21. Sheet dispenser 210 operates based on principles similar to those described in connection with the first embodiment except as specifically described herein.

Sheet dispenser mechanism 210 includes a rotatable picking member 212. Picking member 212 includes a shaft portion 214 that extends along a central axis schematically indicated 216. In the exemplary embodiment shaft portion 214 is rotated about axis 216 by a drive such as a stepping motor which is not separately shown. The picking member may alternatively be referred to herein as a picker member.

Picking member 212 includes a middle disk portion 218. Middle disk portion 218 in the exemplary embodiment is in fixed connection with the shaft portion 214 and rotates therewith. Picking member 212 further includes an outboard disk portion 220 which is disposed from the middle disk portion on a first axial side. Outboard disk portion 220 is also in fixed connection with the shaft portion 214 and rotates therewith. An outboard disk portion 222 is disposed on an opposed axial side of middle disk portion 218. Outboard disk portion 222 is also in fixed connection with the shaft portion and rotates therewith. Because the middle disk portion 218 and the outboard disk portions 220 and 222 are each in fixed engagement with the shaft portion, they maintain their relative angular positions as the shaft portion is rotated during the picking of notes.

In the exemplary embodiment, middle disk portion 218 is comprised of a generally rigid plastic material. The middle disk portion includes a low friction arcuate surface 224 that extends angularly around a substantial portion of the middle disk portion. Low friction arcuate portion 224 has extending therein a recess (not separately shown). A band 226 of generally higher friction resilient material extends around the middle disk portion in the recess. The band 226 and recess include an enlarged area 228 in which the band extends across most of the outer surface of the middle disk portion. As later described in detail, the enlarged area 228 of the band serves as a high friction arcuate segment that facilitates the picking of notes from a stack.

Outboard disk portion 220 in the exemplary embodiment is also comprised of generally rigid low friction material. Outboard disk portion 220 includes an outer surface 230 which includes a recess therein (not separately shown). A band 232 of resilient material extends in the recess and extends around the entire circumference of the outer surface. The band 232 includes a high friction segment 234. The high friction segment 234 corresponds in angular position to at least a portion of the enlarged area 228 on the middle disk portion. In the exemplary embodiment of outboard disk portion 220, flange portions 236 bound the recess and the band 232. The flange portions 236 extend further radially outward relative to axis 216 than the outer surface of the band 232 except in the area of the high friction segment 234. In the area of the high friction segment the band 232 extends radially outward beyond the radial height of the flange portions 236 so as to facilitate picking.

Outboard disk portion 222 is similar in structure to outboard disk portion 220. Outboard disk portion 222 includes an outer surface 238 which includes a recess and in which a band 240 extends. The outer surface 238 includes flange portions 242 which bound the recess and the band. Band 240 includes a high friction segment 244 which extends radially outward beyond the flange portions. High friction segment 244 is generally aligned angularly with high friction segment 234 on outboard disk portion 220.

A stripping member 246 is positioned in opposed engaging relation with the middle disk portion 218. In the exemplary embodiment the stripping member 246 comprises a roll which is supported on a shaft 248. The stripping member 246 has in connection therewith a one-way clutch which may operate in the manner previously described. The clutch operates to resist rotation of the stripping member in a direction in which the stripping member is urged to move by engagement with the middle disk portion, but enables the stripping member to rotate readily in an opposed direction so as to enable the return of notes into the stack. In the exemplary embodiment stripping member 246 has a guide member 250 that extends in overlying relation thereof. The guide member includes an upper surface which has a contour that facilitates the directing of notes into the nip area where the stripping member 246 engages the middle disk portion (see FIG. 20).

In the exemplary embodiment the stripping member 246 is positioned relative to the middle disk portion 218 such that the surface of the stripping member is in opposed engaging relation with the surface of the low friction arcuate portion 224 of the middle disk portion. As a result the stripping member 246 which is biased to engage the middle disk portion in a manner later discussed, generally slides readily relative to the middle disk portion except when the surface of the stripping member is engaged in the enlarged area 228. When the enlarged area 228 is in abutting opposed relation with the stripping member, the end note bounding a stack of notes is stripped from the other notes in the stack in a manner that is later discussed.

Figures 18, 18A:
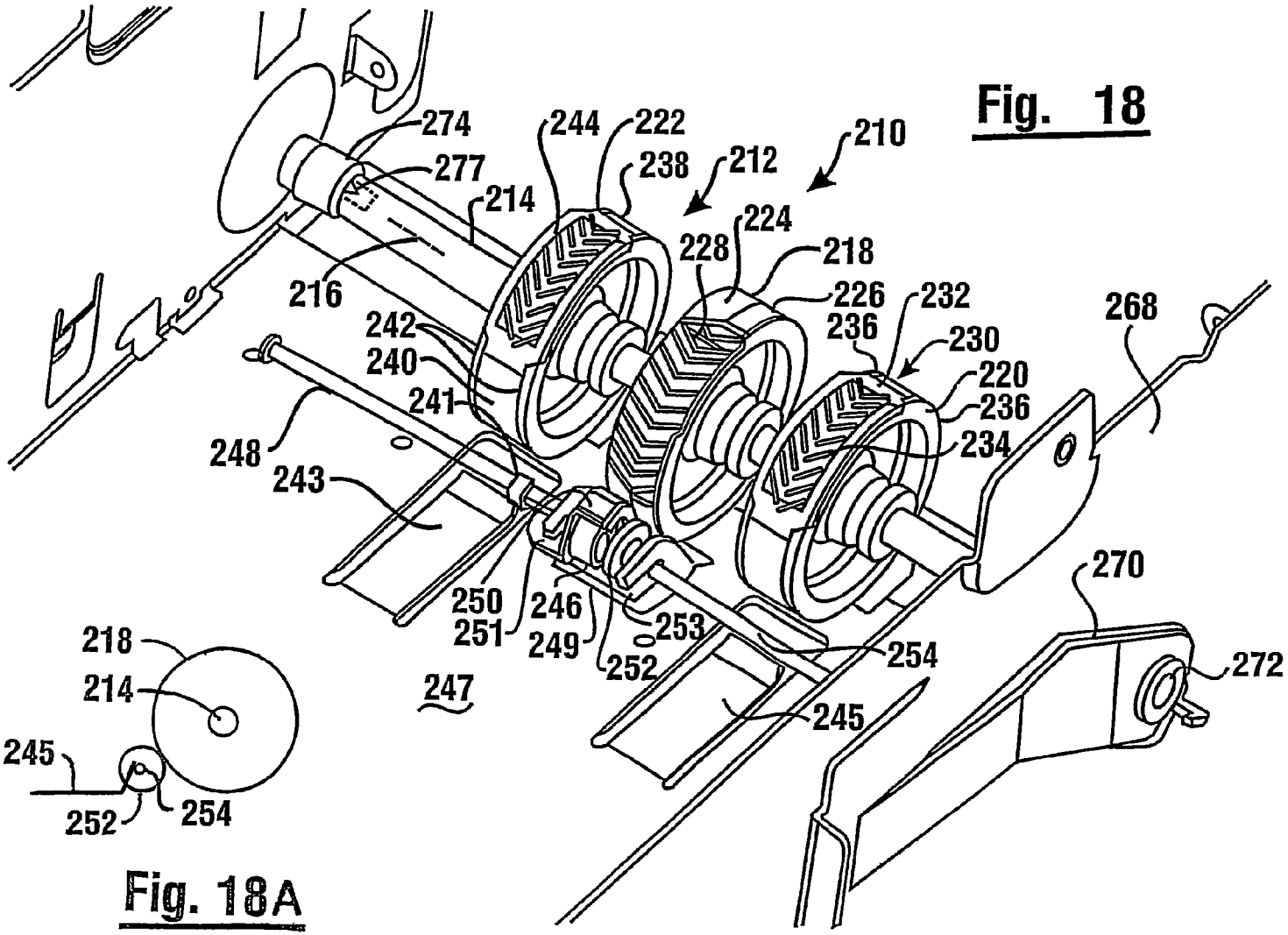
FIG. 18 is a top right isometric view of an alternative form of a picking member and stripping member adapted for minimizing the nicking and crumpling of notes during picking.
FIG. 18A shows a side view of a spring portion biasing a shaft to cause an engagement with a disk.
Figure 20:
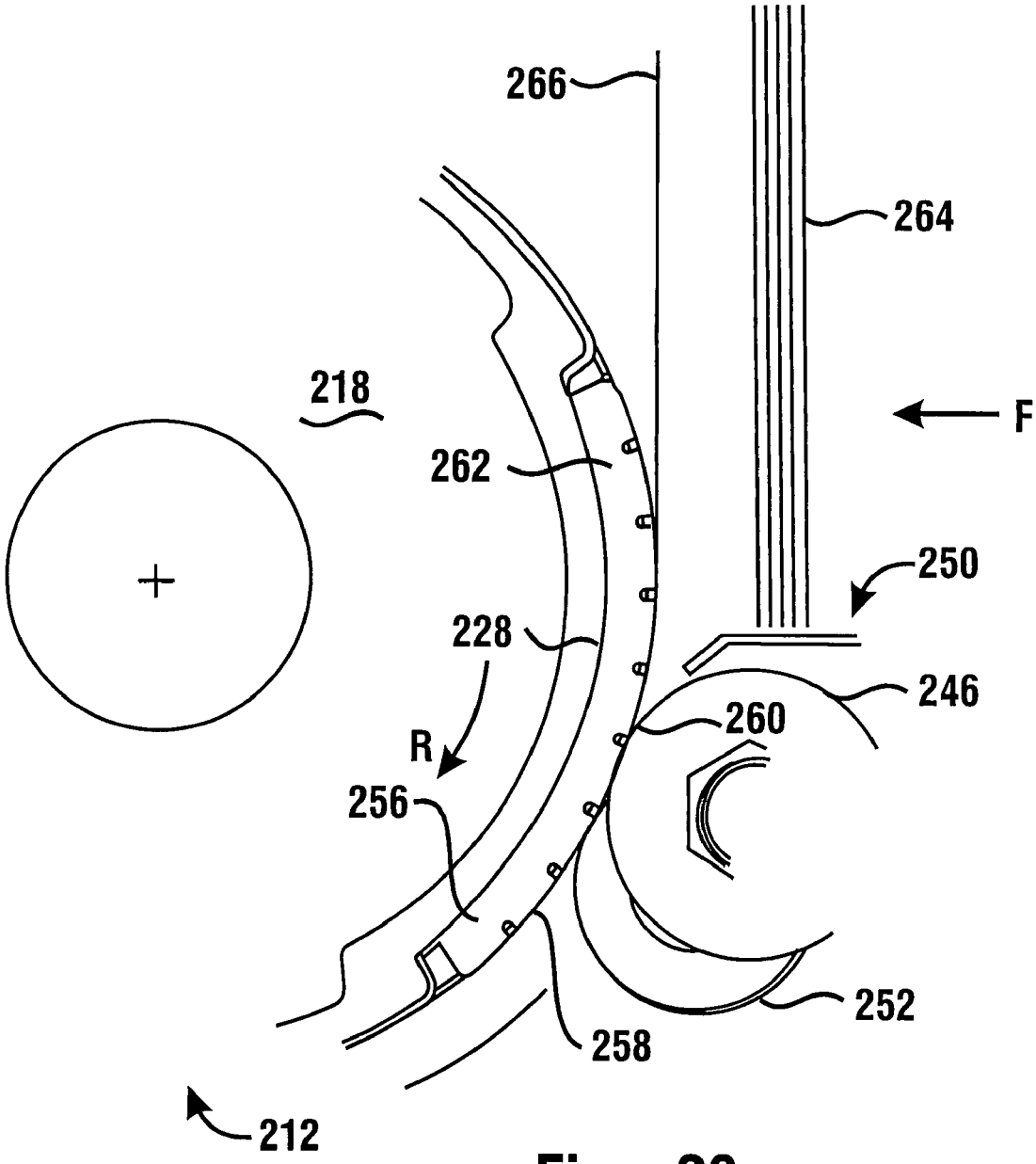
FIG. 20 is a left side view of the middle disk portion of the picking member, stripping member and takeaway roll in engagement with an end note bounding a stack.

As shown in FIG. 18 a carry away member which in the exemplary embodiment comprises a roll 252 is also mounted in opposed engaging relation with the middle disk portion 218. The carry away roll 252 is supported on a shaft 254 and is biased to engage the middle disk portion. The carry away roll 252 is aligned with the area of the recess in the middle disk portion that extends about the entire circumference of such disk portion. As a result the carry away roll generally remains in engagement with the resilient band 226 throughout the entire rotation of the middle disk portion except during the time that a note is moving therebetween. The exemplary form of carry away roll 252 is disposed downward and in an angular direction away from the stripping area in which the stripping member 246 engages the middle disk portion. This is shown in FIG. 20. As a result in the exemplary embodiment the carry away roll operates to engage a note that has been separated from the stack by the action of the stripping member and the enlarged area 228, and moves the separated note responsive to the movement of the picking member so that the separated note is moved away from the stack. In some embodiments this may avoid the need for a separate drive device for carry away rolls, as the movement of the picking member itself drives the carry away roll to move separated notes away from the stack.

As shown in FIG. 18 a lower housing wall 247 supports a support member 249 thereon. Support member 249 includes slots 251 and 253 therein which accept shafts 248 and 254 therein, respectively. Wall 247 also has integrally formed therein leaf springs portions 243, 245. Leaf spring portion 243 biases shaft 248 and stripping member 246 toward middle disk portion 218 by biasingly engaging a clip portion 241 of member 250. Spring portion 245 acts on shaft 254 to bias carry away roll 252 to engage the middle disk portion 218, which is also shown in FIG. 18A. The ends of each shaft 248 and 254 opposed of the roller is mounted in supporting connection with the housing through a releasable pivot connection (not separately shown) which enables each roll to maintain biasing engagement with the middle disk portion. The pivot connection enables each of the stripping member and carry away member and their respective shafts to be released from operative supporting connection from the housing and replaced. Of course, in other embodiments other releasable mounting arrangements may be used.

Figure 19:
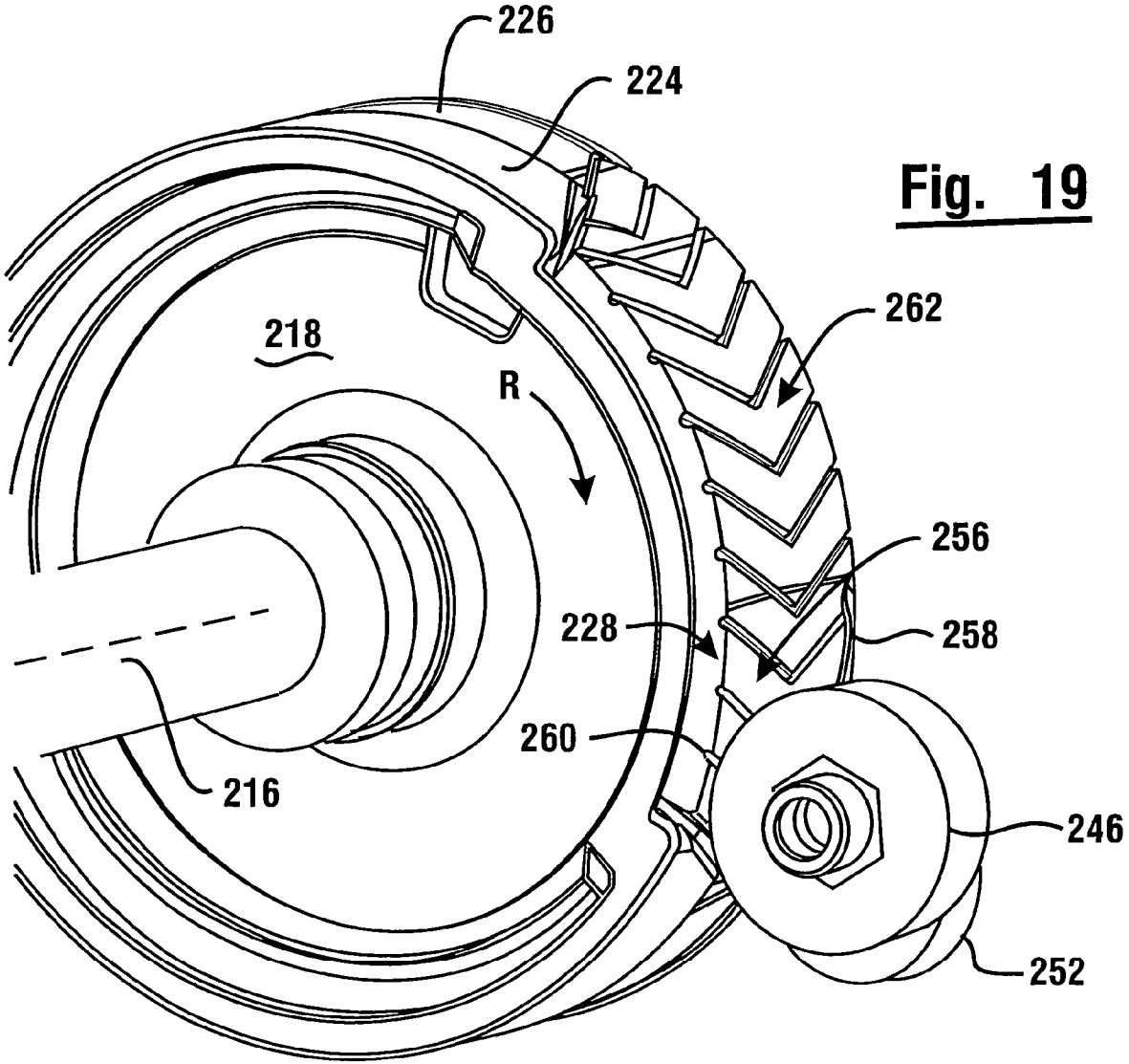
FIG. 19 is a left isometric view of a middle disk portion of the picking member, stripper member and takeaway roll shown in FIG. 18.

As shown in more detail in FIG. 19 the enlarged area 228 on the middle disk portion 218 includes a leading area 256. The leading area 256 has extending transversely adjacent thereto, an arcuate projecting portion 258. The arcuate projecting portion 258 in the exemplary embodiment comprises an extension of the outer surface of the middle disk portion 218. The arcuate projecting portion 258 extends radially outward relative to the axis beyond the outer surface of the band 226 in the leading area 256. The arcuate projecting portion is also disposed adjacent to but transversely away from a stripping area 260 in which the stripping member 246 engages the leading area 256 of the enlarged area 228 of the band.

In the exemplary embodiment the arcuate projecting portion 258 arcuately extends up to a driving area indicated 252 in the enlarged area 228 of the band. In the driving area the band extends further radially outward relative to the leading area 256. The driving area 252 generally corresponds angularly to the positions of the high friction arcuate segments 234 and 244 on the outboard disk portions 220 and 222 respectively. As shown in FIG. 19 the enlarged area 228 of the resilient band includes a ribbed design that is consistent across the leading area 256 and the driving area 262. In some embodiments the ribbed design may serve to provide desirable frictional properties for the band. Of course in other embodiments other designs for tread surfaces as well as other types of frictional materials may be used.

Figure 21:
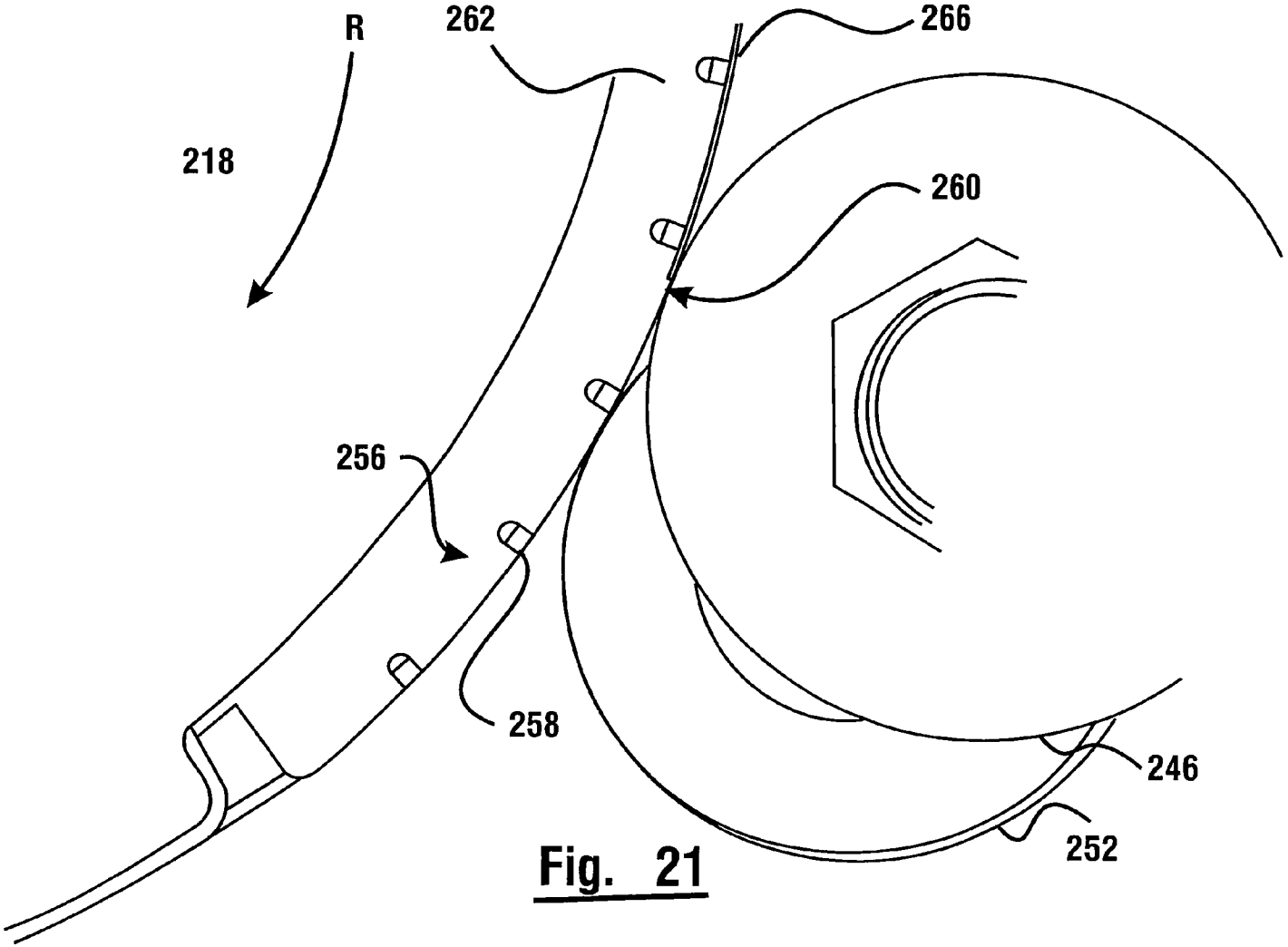
FIG. 21 is an enlarged view of the components shown in FIG. 20.

The operation of the alternative exemplary sheet dispensing mechanism 210 is now described with reference to FIGS. 19-21. A stack of notes schematically indicated 264 is bounded by an end note 266. In exemplary embodiments the stack 264 may generally be contained within a removable canister or other suitable holding container. Of course alternative approaches for holding a stack of notes may also be used. The stack 264 is biased in the direction of Arrow F in FIG. 20 by a suitable biasing device so as to urge the end note 266 of the stack to engage the picking member including disk portions 218, 220 and 222.

As in the previously described embodiment the end note 266 is separated from the stack by rotation of the picker member 212 in the direction of Arrow R as shown in FIG. 20. The rotation of the picking member 212 generally does not cause the end note 266 to move substantially relative to the stack except when the driving area 262 of the middle disk portion and the high friction segments 234 and 244 of the outboard disk portions are engaged with the end note. This is because of the relatively low friction engagement between the outer surfaces of the disk portions and the end note in the other areas about the circumference of the disk portions.

As the picking member rotates a full rotation the end note 266 is moved relative the stack. In the exemplary embodiment rotation of the picking member brings the leading area 256 adjacent the forward boundary of the enlarged area 228 of the band 226 on the middle disk portion into engagement the outer surface of the stripping member 246 in the stripping area 260 as shown in FIGS. 20 and 21. The forces of the relatively moving leading area and non-moving outer surface of the stripping member acting on a leading edge area and opposed sides of the end note cause the note to begin to be separated from and in many cases to begin moving responsive to the rotation of the picking member relative to the stack. However, in the exemplary embodiment while the leading edge area of the end note 266 is engaged with the leading area 256 of the picking member, the end note is also engaged with the surface of the transversely adjacent arcuate projecting portion 258 of the middle disk portion. This engagement of the end note with the arcuate projecting portion in a support area that is adjacent, but somewhat axially transversely disposed from the stripping area, serves to support the note and to reduce the risk that the leading edge area of the note will be deformed such as crumpled or nicked by the opposed forces imparted to the note by the action of the enlarged area of the band and the stripping member. Thus the surface of the arcuate projecting portion serves to prevent excessive deformation of the note along a direction which the note is urged to move by the picking member due to the opposing force applied by the stripping member. The angled treads of the exemplary picking member underlying the leading edge area of the note in opposed relation of the stripping member further serve to enable relative movement of the picking member with regard to the note without causing potentially damaging deformation.

Further rotation of the middle disk portion in the direction of Arrow R causes the arcuate projecting portion to rotate beyond the stripping area where the stripping member 246 engages the enlarged area 228. Further such rotation causes the driving area 262 which has an outer surface that extends further radially outward from the leading area to engage the adjacent surface of the end note. This imparts additional force urging the end note 266 to move relative to the stack. Further at generally the same time during the rotation of the picking member, the high friction arcuate segments 234 and 244 on the outboard disk portions also act on the end note further urging it to move relative to the stack. These forces acting on the end note cause the end note to move further in intermediate relation between the band 226 and the stripping member 246 and to engage the carry away roll 252. The end note 266 moves in engaged intermediate relation between the band 226 on the middle disk portion and the carry away roll 252 which further helps to move the end note away from the stack and the picking member.

Of course as previously described in connection with the other exemplary embodiment, if a double note is sensed as having been picked, the controller may be operative to cause the direction of the picking member to be reversed. This is done before the note is disengaged from the picking member so as to move the note back into the stack. Thereafter the controller may operate to cause the picking member to again attempt to pick the end note so that it is separated from other notes in the stack.

The features described in connection with the sheet dispensing mechanism 210 may prove useful in circumstances where the notes or other sheets that are to be picked may tend to be crumpled or have the leading edge thereof nicked or torn by the forces imparted to the sheet as a result of stripping action. In the exemplary embodiment the forces imparted to the sheet initially by the leading area serve to move a central portion of the leading edge of the sheet into the nip formed by the middle disk portion and the stripping member, while a transversely adjacent area is supported by the low friction arcuate projecting portion, is operative to reduce the likelihood of nicking or crumpling the notes in the area where the stripping forces are applied to the notes. Such features may be particularly helpful in the case of thin, flexible and/or fragile notes or media that is susceptible to crumpling or tearing. Further, avoiding deformation of the leading edge of the notes also reduces the risk that such a deformed or damaged note will be sensed by a doubles detector as a double or other unrecognizable note. This reduces the risk that such a note will be retracted into the stack. Such retraction of a properly picked single note may not be necessary. Further in some embodiments a return to the stack and additional attempts to pick the note from the stack may result in further damage or tearing of the note. This may pose additional complications and/or may cause the machine to be placed out of service.

It should be understood that the structures shown in connection with the sheet dispensing mechanism are exemplary and in other embodiments other approaches of providing stripping action while simultaneously providing support in a support area so as to minimize sheet damage may be used. For example in some embodiments additional surfaces or devices for providing support may be provided on the picking member, the stripping member or on other structures. Further it should be understood that although in the described embodiment a single stripping member is utilized, the principles described may be applied to devices in which multiple stripping members are used.

As shown in FIG. 18, the exemplary embodiment of the sheet dispensing mechanism 210 also provides for ready change of the picking member 212. In this exemplary embodiment the housing 268 which supports the sheet dispensing mechanism includes a tab portion 270 thereon. Tab portion 270 includes a bushing 272 adjacent to a free end thereof. Bushing 272 is adapted to accept therein a cylindrical projecting portion at the end of shaft portion 214. This projecting portion is readily releasibly engageable in the bushing 272 in the exemplary embodiment. The end of shaft portion 214 opposed of the bushing 272 is releasibly engageable with a drive shaft 274. In the exemplary embodiment the drive shaft 274 includes a cylindrical projecting portion that extends in a mating recess within the shaft portion 214. A driving projection in operative connection with the drive shaft 274 is accepted in a corresponding recess in the shaft portion 214 so as to provide generally solid rotational driving engagement between the drive shaft 274 and the picking member 212. As a result, in the described exemplary embodiment the picking member 212 may be replaced by deforming the resilient tab portion 270 outward relative to the housing 268. This provides additional clearance such that the shaft portion 214 may be disengaged from the drive shaft 274 and the bushing 272. Thereafter a substitute picking member may be inserted and will be held in place by the inward biasing force of the tab portion 270. Of course this approach is exemplary and other approaches may be used.

In the exemplary embodiment, before the picking member is removed from supporting connection with the housing it is generally advisable to dispose the stripping member and carry away member away from the middle disk portion. This provides greater access to the picking member and enables it to be moved out of the housing for inspection or replacement purposes. In addition, it is occasionally necessary to replace the stripping member and/or carry away member for purposes of ensuring the reliable operation of the machine. As can be appreciated, in some situations the stripping member may become worn over time due to repeated contact with note surfaces. Alternatively or in addition, the surface of the stripping member may become contaminated due to the presence of dirt or other material on the notes being dispensed. The surface of the carry away member may also become contaminated for similar reasons which may reduce its efficiency in engaging and urging notes to move between the carry away member and the central disk portion.

When it is desired to move the stripping member 246 away from the middle disk portion 218, a servicer gains access to the appropriate area of the housing 268. This is done in the exemplary embodiment by moving the currency holding canister or cassette which houses a stack of bills or other sheets and which enables the end note in the stack to be biased into adjacent relation with the picking member. Once the sheet holding structure has been removed from the housing, a servicer may manually deform leaf spring portion 243 so as to move the free end of the leaf spring downward such that it no longer holds the stripping member 246 in adjacent relation of the picking member. This can be facilitated in the exemplary embodiment by the servicer applying a force to the stripping member or the shaft 248 so as to initially move the stripping member slightly toward the axis of rotation of the picking member. This enables the leaf spring portion to disengage and to be moved such that the free end thereof is disposed below the shaft 248 and the clip portion 241 of bracket 250. This enables the stripping member 246 to be moved axially away from the axis of rotation of the picking member outward through the slot 251. As previously discussed, in the exemplary embodiment the shaft 248 is in supporting connection with the housing through a pivot mounting such that the stripping member moves arcuately away from the axis of the picking member. Of course this approach is exemplary, and in other embodiments other approaches may be used.

In the position with the stripping member moved away from abutting relation with the picking member, a servicer is enabled to maintain the stripping member disposed away from the axis of the picking member for purposes of inspection or replacement of the picking member. Alternatively, in the exemplary embodiment the stripping member and shaft assembly is enabled to be removed from its mount for purposes of inspection or replacement. As a result, a servicer is enabled to replace a stripping member, guide member, shaft or entire assembly, as required. In addition in the exemplary embodiment, the stripping member has an integral one-way clutch which, as previously discussed, facilitates dealing with situations where multiple sheets are inadvertently picked.

Once the desired parts are replaced, the shaft 248, stripping member and guide member assembly may be engaged with the mounting mechanism to again place them in supporting connection with the housing, and the stripping member moved toward the axis of rotation of the picking member. As this occurs, the shaft 248 moves into the slot 251. Once the stripping member is in the operative position, the leaf spring portion 243 which is biased downward by the clip portion 241 as the stripping member moves into the operative position, is enabled to move upward to engaged the clip portion. This action of the leaf spring portion holds the stripping member in the operative position in biased abutting relation with the central disk portion.

A mounting approach similar to that used for the stripping member may be used for the carry away roll 252. The carry away roll, which is transversely disposed from the stripping member and disposed in the direction of note movement from the point of engagement of the stripping member with the central disk portion, is biased toward engagement with the middle disk portion and held through the action of leaf spring portion 245. Leaf portion 245 in the operative position has a free end which engages shaft 254 which is in supporting connection with the carry away roll. In the operative position, shaft 254 extends in slot 253 so as to maintain its position relative to the central disk portion. Shaft 254 at an end opposed of the carry away roll is also movably mounted in supporting connection with the housing through a mount which is not separately shown. Of course this approach is exemplary, and in other embodiments other approaches may be used.

In the exemplary embodiment the carry away roll 252 is enabled to be moved away from the axis of the picking member. This is accomplished by a servicer deforming leaf spring portion 245 so that is no longer engages shaft 254, so as to hold the carry away member in the operative position. In the exemplary embodiment this may be facilitated by the servicer biasing the shaft and/or carry away member slightly towards the picking member while deforming the leaf spring portion 245 such that the free end thereof may pass underneath shaft 254. Shaft 254 may then be moved rearward away from the axis of rotation of the picking member through the slot 253. Again, in this position the carry away member may be maintained so as to provide access for inspecting or replacing the picking member. Alternatively in the exemplary embodiment, the carry away roll may be replaced along with the shaft 254 by disengaging the shaft from its mounting mechanism.

When it is desired to return the carry away roll to the operative position after service activities or replacement, the shaft 254 is returned to its rotatable mounting mechanism and the carry away roll 252 is moved toward the axis of rotation of the picking member and into the slot 253. As this occurs, the leaf spring portion 245 has the free end thereof biased downward until the shaft 254 passes the free end. Once the shaft 254 has moved sufficiently forward toward the axis of the picking member, the free end of leaf spring portion 245 moves upward to hold the shaft into a position in which is biasly toward engagement with the middle disk portion.

It should also be noted that this exemplary approach has the advantage that the carry away roll and stripping member may be disposed from the support member 249. This also enables more ready replacement of the support member in the event that the support member sustains breakage or wear. Such replacement may be accomplished through the use of various fastener mechanisms which are operative to releasibly hold the support member in engagement with the housing. It should also be understood that in conducting servicing activities in the exemplary embodiment, generally it will be desirable to move the stripping member and carry away roll to the operative position once the picking member is in place in supporting connection with the drive shaft 274 and the tab portion 272. However, in some circumstances servicers may find it useful to move one or both of the stripping member and carry away roll into the operative position and then to install the picking member into engagement with the drive shaft and tab portion. The approach used will depend on the circumstances and the nature of the servicing activity.

Figure 12:
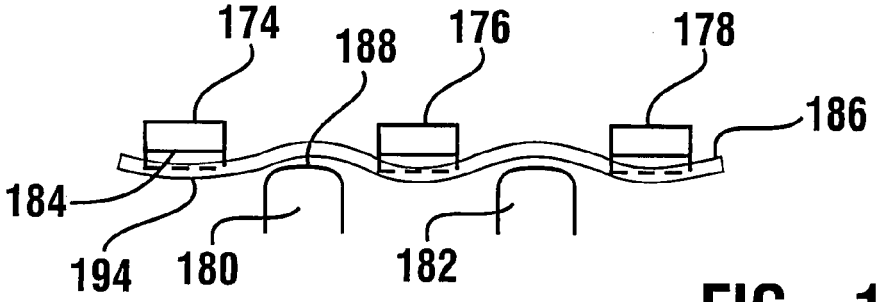
FIG. 12 is a side cross sectional view of the sheet transport showing a sheet in engagement with a plurality of belt flights and projecting member portions.

In an exemplary embodiment a note transport such as note transport 54, includes features to reduce the risk that notes may become stuck or jammed in the transport. As previously discussed in connection with FIG. 1, note transport 54 includes a plurality of continuous belts 56 which extend about sets of rollers 58. It should be understood that the transport 54 may include belts that extend the entire length of the transport or may have several belts which span sections of the transport. In an exemplary embodiment the continuous belts are arranged so that the transport includes a plurality of generally parallel belt flights. These belt flights are represented in FIG. 12 by belt flights 174, 176 and 178. Each of the belt flights extend along a longitudinal direction of the transport, in which longitudinal direction sheets are moved. The belt flights are moved through operation of a drive or similar moving mechanism which is controlled responsive to operation of the controller 22 and which drives the rollers upon which the belts are supported.

As shown in FIG. 12, disposed transversely intermediate of each adjacent pair of belt flights, are projecting member portions 180, 182. As can be readily seen from FIG. 12, each of the belt flights has a first sheet engaging surface represented by surface 184 of belt flight 174, which faces in a first facing direction toward a sheet 186 which extends in the transport. The projecting member portions each include a second sheet engaging surface represented by surface 188 of projecting member portion 180. The second sheet engaging surface 188 faces in a second facing direction which is generally opposed of the first facing direction. As will be appreciated the first and second facing directions in which the sheet engaging surfaces of the belt flights and the projecting member portions extend respectively, are both generally normal of the longitudinal direction in which the sheets move.

Figure 13:
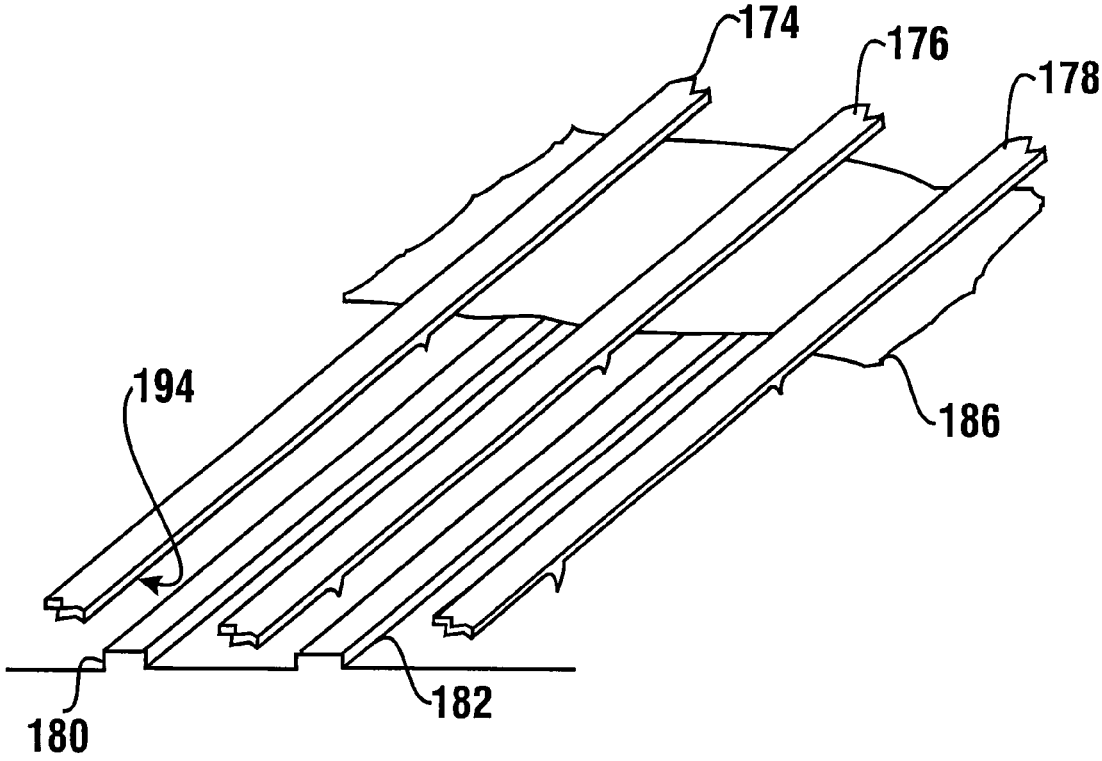
FIG. 13 is an isometric view of a sheet transport including belt flights of the type shown in FIG. 11 operating to move a sheet through the transport.

As can be appreciated from FIGS. 12 and 13, the configuration of the first belt flights and the sheet engaging member portion is such that a sheet that is moved into intermediate relation between the first sheet engaging surface of the belt flights and the second sheet engaging surfaces of the projection member portions, is deformed in a wavelike configuration so that the sheet is engaged with the belt flights. As a result when the belt flights move, the sheet 186 moves in engagement therewith.

As can be appreciated from FIG. 14, the sheet transport 54 is enabled to accept sheets such as a sheet 190 through openings such as opening 192. As can be appreciated, from FIG. 14, a sheet passing through the opening in the projecting member portions moves in engagement with the first belt flights to become trapped in sandwiched relation between the belt flights and the projecting member portions. The sheet once trapped in this manner is caused to be moved along with the belt flights to a desired location within the machine responsive to signals from the controller.

As mentioned previously, occasionally sheets such as bank notes become stuck in transports of this type. This may result due to various conditions which prevent the notes from moving in coordinated relation with the belt flights. In the exemplary embodiment conventional type belts which have in the past been used in transports of this type are replaced with alternative belts which reduce the risk that sheets will become stuck. Specifically while prior belts have a generally smooth continuous sheet engaging surface, the alternative belts used of the exemplary form include at least one longitudinally spaced projection which extends in the first facing direction from the sheet engaging surface of the belt. In a more preferred exemplary form such longitudinally spaced projections extend at spaced intervals on the first sheet engaging surface of the belt. The presence of such longitudinally spaced extending projections engage sheets that might otherwise not move in the transport and move them to the desired location.

Figure 11:
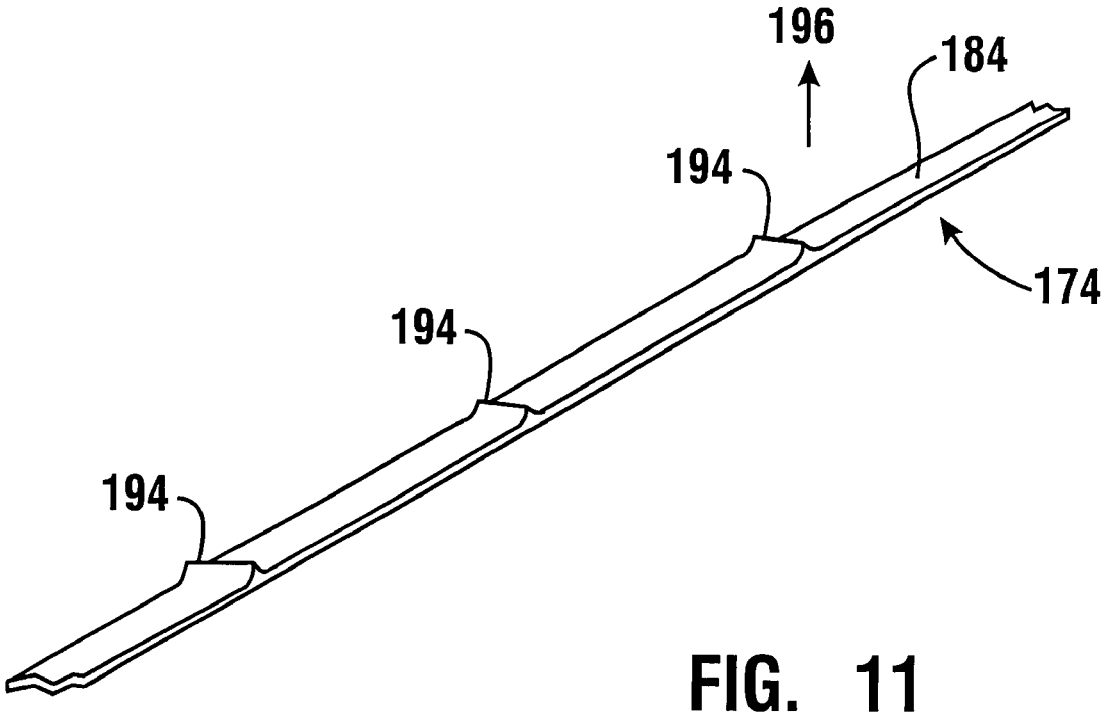
FIG. 11 is an isometric view of a portion of a belt flight including longitudinally spaced projections thereon.

FIG. 11 shows an isometric view of belt flight 174 with the first sheet engaging surface 184 thereof turned 180 degrees from that shown in FIG. 13. The first sheet engaging surface 184 includes a plurality of longitudinally spaced projections 194. The projections 194 extend generally in the first facing direction represented by arrow 196. In the exemplary embodiment, the projections 194 are deformable, resilient and spaced from one another a distance that is greater than the length of the sheets that are moved through the associated transport in the longitudinal direction. This enables a sheet to extend between the adjacent longitudinally spaced projections. It should be understood however that other embodiments may have projections with other properties and the projections spaced more closely together. Other alternative embodiments may have the projections spaced far apart, even to the extent of including only one such projection on the continuous sheet engaging surface of a belt.

In some embodiments all of the belts used in connection with a transport may include projections thereon. However in some embodiments it may be desirable only to replace certain belts with alternate belts including such projections. For example in the transport including three belt flights shown in FIG. 13, it may be desirable only to replace the middle belt with an alternate belt. Alternatively it may be desirable to replace the two outward belts with an alternate belt, leaving the middle belt as having a generally smooth continuous outer surface. Various approaches to replacing the belts may be taken depending on the particular type of documents being transported.

As shown in FIG. 13 some embodiments may have multiple belts arranged such that the projections that extend from the first sheet engaging surfaces of the belts are generally transversely aligned. In this way each of the longitudinally spaced projections will maintain generally the same spaced relation relative to the other projections as the belts are moved from the transport. Alternate embodiments may have the belts installed such that there is no predetermined relationship between the projections on each respective adjacent belt. In each situation benefit is obtained as the projections facilitate movement of sheets in the transport.

Figure 15:
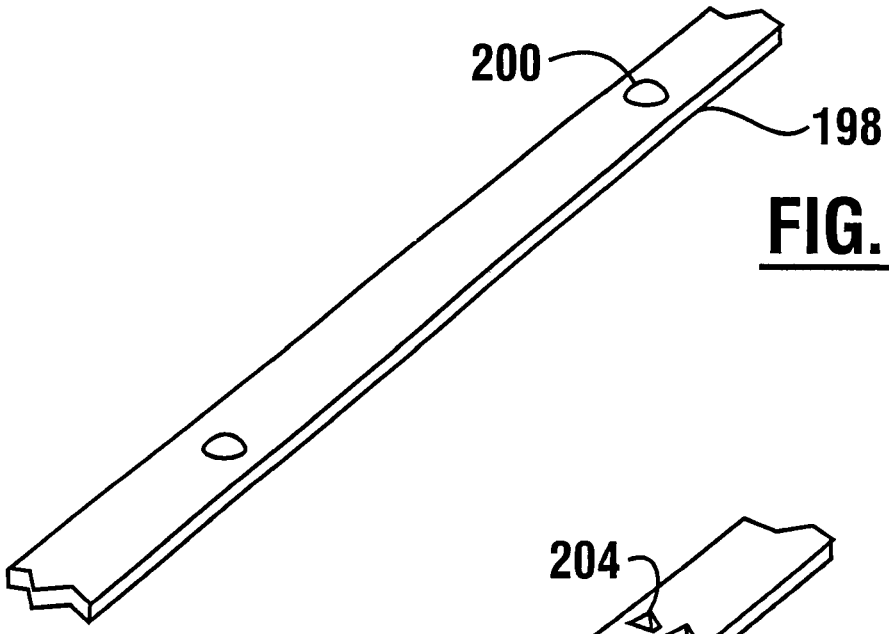
FIGS. 15-17 show alternative exemplary forms of projections positioned on belt flights which may be used in connection with sheet transports including the improvement of the present invention.
Figure 16:
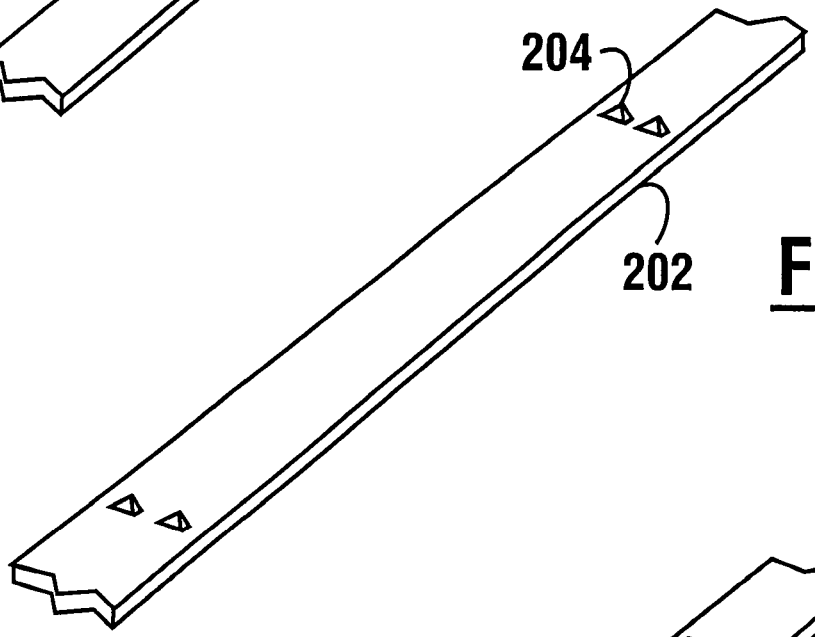
Figure 17:
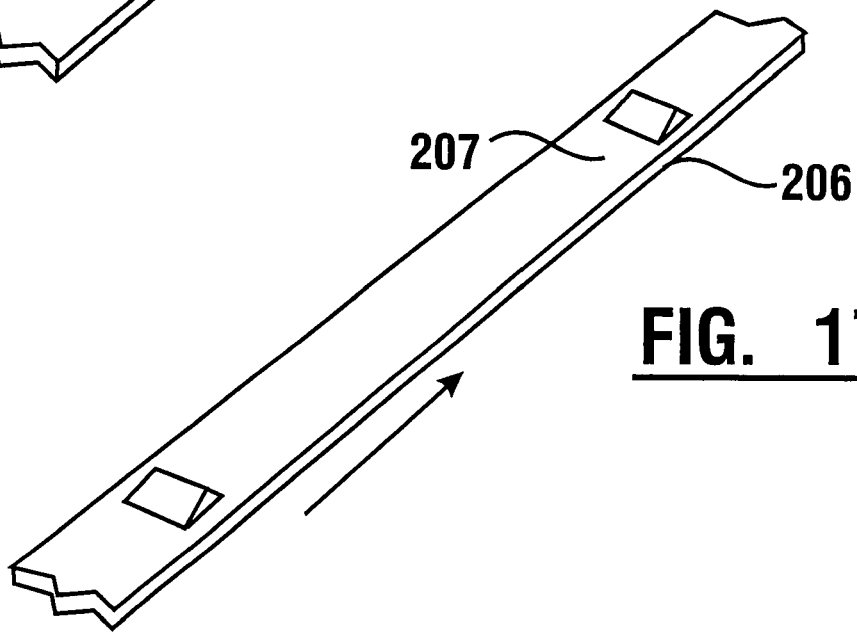

It should be understood that the configuration of belt flight 74 with the longitudinally spaced projections which extend across the first sheet engaging surface of the belt is exemplary. In other embodiments other types of projection configurations may be used. For example, FIG. 15 shows a belt flight 198. Belt flight 198 includes bubble type projections 200. FIG. 16 shows a further alternate belt flight 202 which has adjacent cone-like projections 204. FIG. 17 shows yet a further alternate belt flight 206. Belt flight 206 includes ramp-like projections 207. It should be understood that these belt and projection configurations are exemplary and in other embodiments other configurations may be used.

The exemplary form of the transport improvements is designed for use in connection with existing transports which move sheets such as bank notes in an automated banking machine. Belts which include the improvement are made to extend about existing sets of rollers within the machines and to replace existing transport belts which have generally smooth continuous sheet engaging surfaces about the entire periphery thereof. To improve the performance of the transports in such machines, a service person must open the housing of the machine such as by unlocking and opening a door of a secure chest. The service person is then enabled to remove the existing transport belt from a set of rollers which support and move such belt. With the prior belt removed from the transport, an alternative belt of one of the types described herein including longitudinally spaced projections is installed in supporting connection with the set of rollers. The service person may then close and lock the door of the secure chest of the ATM. Sheets may be then moved in the transport urged not only by the relatively smooth portions of the sheet engaging surface of the belt, but further urged to move by engagement with the projections thereon. As can be appreciated, the projections on the belts provide additional urging force that is generally sufficient to move sheets that otherwise might slip or become stuck in a transport.

It should be appreciated that in the exemplary embodiment, the alternate belts described may be used in connection with transport 54 as well as transport 60. The principles of the invention may also be applied to other devices which move sheets within the machine. For example belts which include longitudinally spaced projections of the type described herein may be used in connection with a system for moving stacks of sheets such as is shown in U.S. Pat. No. 5,507,481, the disclosure of which is incorporated herein by reference as if fully rewritten herein. In such transports the projecting member portions comprise moving belt flights which move in coordinated relation with the facing belt flights and serve to transport stacks in between. Alternative belts including projecting portions thereon may be used to move stacks of sheets that are in between and enable movement of such stacks more reliably. As is explained in the incorporated disclosure, such transports in which the projecting member portions comprise moving belt flights enable reliably moving stacks of notes or connected sheets such as passbooks and checkbooks within an automated banking machine.

The principles of the present invention may also be applied to other types of stack and sheet transports including for example, stack accumulation and presentation mechanisms such as is found in U.S. Pat. No. 5,435,542, the disclosure of which is also incorporated herein by reference as if fully rewritten herein. Of course the principles may be applied to other transport mechanisms as well. It should be understood that the improved sheet dispensing functions achieved through utilization of one or more of the principles described herein may be incorporated in automated banking machines with the improved transport features to achieve improved reliability in moving and delivering sheets within the automated banking machine. Of course it should also be understood that in some embodiments the improved picking capabilities will be implemented without the improved transport capabilities and vice versa. The principles described herein may also be applied to other configurations of picking members and devices as well as sheet transports.

Thus the new and improved automated banking machine features described herein achieve at least one of the above stated objectives, eliminate difficulties encountered in the use of prior devices and systems, solve problems and attain the desirable results described herein.

In the foregoing description certain terms have been used for brevity, clarity and understanding, however no unnecessary limitations are to be implied therefrom because such terms are used for descriptive purposes and are intended to be broadly construed. Moreover, the descriptions and illustrations herein are by way of examples and the invention is not limited to the details shown and described.

In the following claims any feature described as a means for performing a function shall be construed as encompassing any means capable of performing the recited function, and shall not be limited to the structures shown herein or mere equivalents thereof.

Having described the features, discoveries and principles of the invention, the manner in which it is constructed and operated, and the advantages and useful results attained; the new and useful structures, devices, elements, arrangements, parts, combinations, systems, equipment, operations, methods, processes and relationships are set forth in the appended claims.

We claim:

1. A method comprising:

(a) applying a force to cause deforming of a leaf spring portion integrally formed on a housing of a currency sheet dispenser mechanism in operative connection with a cash dispensing automated banking machine, which deforming releases force that holds a shaft of a stripping member in a slot and holds the stripping member adjacent a rotatable sheet picking member, wherein a guide in operative connection with the housing of the currency sheet dispenser mechanism includes the slot;

(b) during (a), moving the stripping member away from the rotatable sheet picking member, and moving the axis of the shaft out of the slot;

(c) subsequent to (b), releasing the force applied in (a), wherein the leaf spring portion returns to a position operative: to hold a stripping member adjacent the rotatable sheet picking member; and to hold a shaft of a stripping member in the slot.

2. The method according to claim 1 and further comprising:

(d) deforming a second leaf spring portion integrally formed on the housing releasing force holding a carry away member adjacent the picking member; and (e) subsequent to (d), moving the carry away member away from the picking member.

3. The method according to claim 1 and prior to (a), further comprising:

(d) receiving at least one input from a user through at least one input device on the automated banking machine;

(e) rotating the picking member in engagement with a stack of notes located in the machine, wherein rotation of the picking member causes at least one note to be moved from the stack.

4. The method according to claim 3 and further comprising:

(f) subsequent to (e) and prior to (a), dispensing the at least one note from the machine to the user.

5. The method according to claim 1 wherein (a) includes releasing force holding a stripping member adjacent to a picking member that is operative to pick currency notes from a currency cassette holding currency notes.

6. The method according to claim 5 and further comprising:

(d) moving a currency cassette relative to a cassette picking position, wherein a currency cassette in the cassette picking position is operatively located adjacent to the picking member permitting the picking member to pick currency notes therefrom.

7. The method according to claim 6 wherein (d) includes moving the currency cassette into the cassette picking position, wherein the currency cassette includes currency notes.

8. The method according to claim 7 and further comprising:

(d) subsequent to (e), operating the picking member to pick at least one currency note from the currency cassette.

9. The method according to claim 8 and further comprising:

(e) moving the currency cassette out of the cassette picking position.

10. The method according to claim 6 wherein (d) includes moving the currency cassette out of the cassette picking position.

11. A method comprising:

(a) applying force to a leaf spring integrally formed on a housing of a currency sheet dispenser mechanism in operative connection with a currency dispensing automated banking machine, wherein the leaf spring includes a stripping member holding portion, wherein the force causes the stripping member holding portion to move away from its operative position;

(b) during step (a), moving a currency note stripping member in a direction relative to a rotatable currency note picking member;

(c) moving the currency note stripping member in the direction beyond the operative position of the stripping member holding portion; and (d) releasing the force applied in step (a), wherein the stripping member holding portion returns to its operative position, wherein in its operative position the stripping member holding portion is able to hold the currency note stripping member in an operative stripping position adjacent to the rotatable currency note picking member.

12. The method according to claim 11 wherein step (b) includes moving the currency note stripping member toward the rotatable currency note picking member.

13. The method according to claim 12 wherein step (d) includes moving the stripping member holding portion to hold the currency note stripping member in the operative stripping position adjacent to the rotatable currency note picking member.

14. The method according to claim 11 wherein step (b) includes moving the currency note stripping member away from the rotatable currency note picking member.

15. The method according to claim 11 wherein the leaf spring is elongated in a first direction, wherein the leaf spring includes a first end and a second end, wherein the first end is integrally attached with the housing, wherein the second end is free, wherein the stripping member holding portion comprises the second end, wherein step (a) includes moving the second end relative to the first end.

16. The method according to claim 15 wherein step (b) includes moving the currency note stripping member in the first direction, and wherein step (a) includes moving the second end in a second direction that is generally perpendicular to the first direction.

17. The method according to claim 11 and further comprising:

(e) moving a currency cassette relative to a cassette picking location adjacent to the rotatable currency note picking member, wherein in the cassette picking location the currency cassette is operatively positioned to permit the rotatable currency note picking member to pick currency notes therefrom.

18. A method comprising:

(a) applying a force to cause deforming of a leaf spring integrally formed on a housing of a currency sheet dispenser mechanism in operative connection with an automated banking machine, wherein the deforming both enables a stripping member positioned adjacent to an operative picking position of a picking member to be moved away from the operative picking position, and enables a shaft of the stripping member to move out of a slot, wherein a guide in operative connection with the housing of the currency sheet dispenser mechanism includes the slot;

(b) during (a), moving the stripping member relatively away from the operative picking position and moving the shaft of the stripping member out of the slot; and (c) subsequent to (b) releasing the force applied in (a), wherein the leaf spring returns to a position operative: to hold a stripping member adjacent to the operative picking position; and to hold a shaft of a stripping member in the slot.

19. The method according to claim 18 wherein during (a) and (b) a picking member is engaged in supporting connection with the housing, and further comprising:

(d) subsequent to (a), (b) and (c), disengaging the picking member from supporting connection with the housing.

20. The method according to claim 19 and further comprising:

(e) prior to (d), moving a currency cassette from a cassette picking location adjacent to the operative picking position to a location away from the cassette picking location, wherein in the cassette picking location the currency cassette is operatively positioned to permit the picking member to pick currency notes therefrom.

21. The method according to claim 18, wherein in (a) the housing includes a housing wall, wherein the leaf spring is integrally formed in the housing wall.

22. The method according to claim 1, wherein in (a) the housing includes a housing wall, wherein the leaf spring portion is integrally formed in the housing wall.

* * * * *